US007686426B2

(12) United States Patent
Sugahara

(10) Patent No.: US 7,686,426 B2
(45) Date of Patent: Mar. 30, 2010

(54) LIQUID TRANSPORTING APPARATUS AND LIQUID TRANSPORTING HEAD

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 705 days.

(21) Appl. No.: 11/468,483

(22) Filed: Aug. 30, 2006

(65) Prior Publication Data

US 2007/0070129 A1 Mar. 29, 2007

(30) Foreign Application Priority Data

Aug. 30, 2005 (JP) ..... 2005-249486

(51) Int. Cl.
*B41J 2/06* (2006.01)
*B41J 29/38* (2006.01)

(52) U.S. Cl. ..... 347/55; 347/9

(58) Field of Classification Search ..... 347/54, 347/55, 9

See application file for complete search history.

(56) References Cited

U.S. PATENT DOCUMENTS

| | | | | |
|---|---|---|---|---|
| 4,855,768 | A * | 8/1989 | Iino et al. | 347/55 |
| 5,144,340 | A * | 9/1992 | Hotomi et al. | 347/55 |
| 6,231,177 | B1 | 5/2001 | Cherukuri et al. | |
| 6,926,382 | B2 | 8/2005 | Ito et al. | |
| 2003/0205632 | A1 | 11/2003 | Kim et al. | |

FOREIGN PATENT DOCUMENTS

| | | | |
|---|---|---|---|
| EP | 1477230 | A1 | 11/2004 |
| JP | H02-286346 | A | 11/1990 |
| JP | H03-234628 | A | 10/1991 |
| JP | 2003 326712 | | 11/2003 |
| WO | 9917083 | A1 | 4/1999 |
| WO | 0207503 | A1 | 1/2002 |

OTHER PUBLICATIONS

European Patent Office, European Search Report for Related EP Application No. 06017997 dated Dec. 20, 2007.
American Vacuum Society, J. Vac Sci. Technol. A 8 (4), Jul./Aug. 1990 "An Investigation of Electrowetting-based microactuation."

* cited by examiner

*Primary Examiner*—An H Do
(74) *Attorney, Agent, or Firm*—Baker Botts L.L.P.

(57) ABSTRACT

An ink transporting head includes a plurality of common channels, a plurality of common electrodes formed on each of the common channels, a plurality of individual channels branched from each common channel, a plurality of individual electrodes arranged on each of the individual channels, and an insulating layer which is arranged to cover each of the individual electrodes, and on which an ink may exist only when an electric potential difference between the ink and the individual electrode becomes not less than a predetermined critical electric potential difference. Further, the individual electrodes provided to each ink channel correspond to individual electrodes provided at the same positions of another ink channel, and the corresponding individual electrodes are in mutual conduction. Accordingly, there is provided a liquid transporting head and a liquid transporting apparatus having a simple and small sized formation, in which a matrix drive is possible.

24 Claims, 34 Drawing Sheets

LIQUID TRANSPORTING APPARATUS AND LIQUID TRANSPORTING HEAD

CROSS REFERENCE TO RELATED APPLICATION

The present application claims priority from Japanese Patent Application No. 2005-249486, filed on Aug. 30, 2005, the disclosure of which is incorporated herein by reference in its entirety.

BACKGROUND OF THE INVENTION

1. Field of the Invention

The present invention relates to a liquid transporting apparatus and a liquid transporting head which transport a liquid, 2. Description of the Related Art Ink-jet heads which discharge ink on a printing medium such as a recording paper have been hitherto known as apparatuses which transport the ink. Such ink-jet heads include ink-jet heads having various structures, for example, an ink-jet head which includes a channel unit including a plurality of individual ink channels each of which includes a pressure chamber communicating with a nozzle, and an actuator of a piezoelectric type which imparts a pressure to the ink in the pressure chamber (refer to U.S. Pat. No. 6,926,382 for example).

A normal piezoelectric actuator includes a plurality of individual electrodes corresponding to a plurality of pressure chambers respectively, a common electrode facing these individual electrodes, and a piezoelectric layer formed of a piezoelectric material such as lead zirconate titanate (PZT), which is sandwiched between the individual electrode and the common electrode. Each of the individual electrodes is connected independently to a driving circuit via a wiring pattern formed on a wiring member such as a flexible flat cable, and a drive voltage is selectively applied to the individual electrodes, from the driving circuit. Moreover, when the electric voltage is applied from the driving circuit to a predetermined individual electrode, an electric field is generated in a portion of the piezoelectric layer sandwiched between the individual electrode and the common electrode, and the piezoelectric layer is partially deformed. As the piezoelectric layer is deformed, a pressure is applied to the ink in the pressure chamber, and the ink is discharged from a nozzle communicating with that pressure chamber.

SUMMARY OF THE INVENTION

However, in the ink-jet head mentioned above, a plurality of individual ink channels of a complicated shape including the nozzles and the pressure chambers is formed in the channel unit, and furthermore, an actuator which includes a plurality of individual electrodes, a common electrode, and a piezoelectric layer is arranged on a surface of the channel unit. Thus, since the ink-jet head mentioned above has a considerably complicated structure, a manufacturing cost becomes high. Moreover, since it is necessary to secure a volume of the pressure chamber not less than a certain predetermined volume for discharging a certain amount of ink, it is difficult to arrange densely (in a highly integrated manner) the individual ink channels of the complicated shape each including the nozzle and the pressure chamber, and to reduce a size of the ink-jet head, Furthermore, since the individual electrodes of the piezoelectric actuator are connected independently to a driving circuit via a wiring pattern formed on a wiring member, when the number of the individual electrodes becomes more, the number of wirings also becomes more, and consequently a wiring pattern which is the wiring member becomes complicated. Further, for reducing the size of the ink-jet head, when an attempt is made to arrange the pressure chambers and the individual electrodes corresponding to the pressure chambers highly densely, since it is necessary to form an extremely fine wiring pattern on a substrate of the wiring member of a limited size, a formation of a so-called electrical system becomes complicated, and a cost of the electrical system becomes high due to ballooning of a manufacturing cost of the wiring member.

In view of this, inventors of the present invention have proposed an ink-jet head having a simple channel formation, in which an electrowetting phenomenon is used, as an ink-jet head appropriate for high integration, replacing the ink-jet head of the piezoelectric type (US Patent Application No. 2005-0219330A1). In this case, when a reduction in the size of the ink-jet head and increase in the number of nozzles is implemented, a plurality of channels have to be arranged highly densely and a voltage has to be applied to each of the individual electrodes arranged on each channel. Therefore, the formation of the electrical system becomes complicated and the cost becomes high similarly as in the case when the piezoelectric actuator is used.

An object of the present invention is to provide a liquid transporting apparatus and a liquid transporting head having a simple formation including the electrical system, and of which the size can be reduced easily.

According to a first aspect of the present invention, there is provided a liquid transporting apparatus which transports a liquid having an electroconductivity, including:

a liquid transporting head which includes:

a plurality of common channels, a plurality of individual channel groups each of which corresponds to the common channels, each of which has a plurality of individual channels branched from one of the common channels, a plurality of common electrodes each of which is arranged on a channel forming surface of one of the common channels, and is in direct contact with the liquid in one of the common channels, a plurality of individual electrodes each of which is arranged on a channel forming surface of one of the individual channels, and an insulating layer which is arranged to cover each of the individual electrodes, and in which a wetting angle of the liquid on a surface of the insulating layer is decreased to be not more than a critical wetting angle at which the liquid is remainable on the surface thereof, when an electric potential difference between the liquid in the individual channel and the individual electrode is not less than a predetermined critical electric potential difference; and a control mechanism which controls a liquid transporting operation of the liquid transporting head.

An individual electrode among the individual electrodes provided to one of the individual channels of an individual channel group among the individual channel groups corresponds to another individual electrode provided to one of the individual channels of another individual channel group, and the corresponding individual electrodes are mutually conducted.

According to the first aspect of the present invention, in the liquid transporting head, a plurality of liquid channels, each of the liquid channels including one of the common channels and the individual channels is formed, and a liquid having the electroconductivity (an electroconductive liquid) flows in each of the liquid channels. Moreover, each of the common channels is provided with one of the common electrode which makes the direct contact with the liquid, and the individual electrodes are provided to the individual channels branched from one of the common channels. Furthermore, each of the individual electrode is covered by the insulating layer. Here, in the individual channels, when the electric potential difference is generated between the liquid in contact with the common electrodes and the individual electrodes, the wetting angle of an ink on the surface of the insulating layer is decreased. A so-called electrowetting phenomenon occurs (refer to Japanese Patent Application Laid-open Publication No. 2003-177219 for example). When the electric potential difference between the liquid in the individual channels and the individual electrodes is not less than the critical electric potential difference, the wetting angle of the ink on the surface of the insulating layer is reduced up to the critical wetting angle or less, at which the liquid can exist on the surface thereof (at which the liquid is remainbale on the surface thereof).

Consequently, by changing the wetting angle of the liquid on the surface of the insulating layer by setting appropriately the electric potential difference between the liquid (common electrodes) and the individual electrodes, it is possible to transport the liquid in the individual channel. According to this formation, as compared to conventional ink-jet heads, a structure of the liquid channels and a structure of an actuator which transports the liquid become simple. In addition, it is possible to arrange the liquid channels highly densely, and to reduce a size of the liquid transporting head. Moreover, as compared to the conventional actuator which applies the pressure by deformation of a piezoelectric element when the electric field is generated, it is possible to transport the ink in the individual channel at a lower electrical energy. Furthermore, since the individual electrodes corresponding between the liquid channels are in mutual conduction, it is possible to apply commonly a predetermined electric potential by one wiring, to the individual electrodes which are in mutual conduction. Furthermore, while realizing such wiring saving, by performing a matrix drive (group drive) which will be described later, it is possible to transport the liquid in the individual channel corresponding to any individual electrode. Therefore, it is possible to reduce the number of wirings connected to the individual electrode, and to reduce the cost of the electrical system.

The liquid transporting apparatus of the present invention may further include an electric potential applying unit which applies an electric potential to the common electrodes and the individual electrodes. Each of the individual channels may have a discharge port through which a liquid is discharged, and the control mechanism may set the electric potential difference between the liquid and the individual electrode by applying a predetermined electric potential selectively to the common electrodes and the individual electrodes with the electric potential applying unit. In this case, by applying selectively the predetermined electric potential to the common electrode and the individual electrode, and by setting appropriately the electric potential difference between the liquid and the individual electrode, it is possible to transport the liquid to the discharge port, and to discharge the liquid form the discharge port, in a desired individual channel.

The liquid transporting apparatus of the present invention may further include a pressure applying mechanism which applies a pressure which generates a flow of the liquid toward the discharge port to the liquid in the individual channels. A magnitude of the pressure applied to the liquid by the pressure applying mechanism may be such that the liquid is discharged from the discharge port when the electric potential difference between the liquid and the individual electrodes is set to be not less than the predetermined critical electric potential difference by the control mechanism. In this case, when the electric potential difference between the liquid and the individual electrodes becomes not less than the predetermined critical electric potential difference, since the liquid to which the pressure is applied by the pressure applying unit flows crossing over the surface of the insulating layer, toward the discharge port, the liquid is discharged assuredly from the discharge port, In the liquid transporting apparatus of the present invention, the electric potential applying unit may apply selectively two types of predetermined electric potentials, which are a first electric potential and a second electric potential, to the common electrodes, and may apply selectively another two types of predetermined electric potentials, which are a third electric potential and a fourth electric potential, to the individual electrodes which are mutually conducted, and only when the first electric potential is applied to a certain common electrode among the common electrodes and the third electric potential is applied to an individual electrode among the individual electrodes formed on the individual channels of the individual channel groups corresponding to a common channel on which the certain common electrode is formed, a potential difference between the liquid in the individual channel, to which the individual electrode is provided, and the individual electrode may become not less than the critical electric potential difference.

When the individual electrodes corresponding between the individual channel groups are in conduction for reducing the number of wirings to be connected to the individual electrodes, since a common electric potential is applied simultaneously to the individual electrodes which are in mutual conduction, when the electric potential of a certain common electrode is a constant electric potential, it is not possible to transport the liquid only in a particular individual channel. However, by applying selectively the electric potential of the two types namely the first electric potential and the second electric potential to the certain common electrode, and by applying selectively the electric potential of the two types namely the third electric potential and the fourth electric potential to the particular individual electrode, by the electric potential applying unit, only in a desired individual channel, it is possible to transport the liquid in that individual channel by letting the electric potential difference between the liquid and the individual electrode to be not less than the critical electric potential difference, and reducing the wetting angle of the liquid on the insulating layer up to the critical wetting angle or less. Concretely, since the electric potential difference between the liquid and the individual electrode becomes not less than the critical electric potential difference when the first electric potential is applied to the common electrode and the third electric potential is applied to the individual electrode, the wetting angle of the liquid on the insulating layer becomes equal to or less than the critical wetting angle, and it is possible to transport the liquid on the surface of the insulating layer, and the liquid is transported in this individual channel. On the other hand, in a combination of the electric potential difference other than the one mentioned above, the electric potential difference between the liquid and the individual electrode becomes less than the critical electric potential difference, and the liquid on the surface of the insulating layer is not transported, and for this individual channel, the liquid is not transported.

In the liquid transporting apparatus of the present invention, among the first to fourth electric potentials, the third electric potential may be maximum and the first electric potential may be minimum, or the first electric potential may be maximum and the third electric potential may be minimum. In this case, since a substantial difference can be easily obtained between an electric potential difference between the liquid and one of the individual electrodes in the individual channels in which the liquid is transported (a difference between the first electric potential and the third electric potential), and an electric potential difference between the liquid and the individual electrode in the individual channel in which the liquid is not transported, (a difference between the first electric potential and the fourth electric potential, a difference between the second electric potential and the third electric potential, and a difference between the second electric potential and the fourth electric potential), it is possible to perform stably a liquid transporting operation and a stopping operation.

In the liquid transporting apparatus of the present invention, one of the first to fourth electric potentials may be ground electric potential. According to this formation, since the types of the electric potential applied to the common electrodes or the individual electrodes by the electric potential applying unit is reduced, it is possible to make simple a formation of the electric potential applying unit, and to reduce the cost.

In the liquid transporting apparatus of the present invention, electric potentials may be same between one of pairs of the first electric potential and the fourth electric potential, the second electric potential and the third electric potential, and the second electric potential and the fourth electric potential. In this case, since the types of the electric potential applied to the common electrodes or the individual electrodes by the electric potential applying unit is reduced, it is possible to make simple the formation of the electric potential applying unit, and to reduce the cost.

In the liquid transporting apparatus of the present invention, the fourth electric potential may be equal to the first electric potential $V_1$, and $V_2=(V_1+V_3)/2$ may be satisfied when the second electric potential is $V_2$ and the third electric potential is $V_3$. It is possible to perform stably the liquid transporting operation and the (liquid transporting) stopping operation by setting the second electric potential $V_2$ in such manner, because it is possible to secure a minimum electric potential difference of $|V_3-V_1|/2$ between the electric potential difference between the liquid and the individual electrode in the individual channel in which the liquid is transported (the difference between the first electric potential and the third electric potential), and the electric potential difference between the liquid and the individual electrode, in the individual channel in which the liquid is not transported (the difference between the first and the fourth electric potential, the difference between the second and the third electric potential, and the difference between the second and the fourth electric potential).

In the liquid transporting apparatus of the present invention, the first electric potential and the fourth electric potential may be ground electric potential or the second electric potential may be ground electric potential. In these cases, since the types of the electric potential applied to the common electrodes or the individual electrodes by the electric potential applying unit becomes two types, it is possible to simplify further the formation of the electric potential applying unit.

In the liquid transporting apparatus of the present invention, $V_2=(2V_3+V_1)/3$ and $V_4-(V_3+2V)/3$ maybe established when the first to forth electric potentials are $V_1$, $V_2$, $V_3$ and $V_4$ respectively in this case, since it is possible to secure an electric potential difference of $|V_3-V_1|\times 2/3$ between the electric potential difference between the liquid and the individual electrode in the individual channel in which the liquid is transported (the difference between the first electric potential and the third electric potential), and the electric potential difference between the liquid and the individual electrode in the individual channel in which the liquid is not transported (the difference between the first electric potential and the fourth electric potential, the difference between the second electric potential and the third electric potential, and the difference between the second electric potential and the fourth electric potential), it is possible to perform stably the liquid transporting operation and the stopping operation.

In the liquid transporting apparatus of the present invention, when the electric potential difference between the liquid and an individual electrode among the individual electrodes is not less than the critical electric potential difference, the liquid may exist on the surface of the insulating layer and a meniscus of the liquid maybe formed near the discharge port, and the liquid in the individual channels may not be discharged from the discharge port; and when the electric potential difference between the liquid and an individual electrode among the individual electrodes is set to be less than the predetermined critical electric potential difference, the liquid which existed on the surface of the insulating layer may move to the discharge port to be discharged from the discharge port.

When the electric potential difference between the liquid and the individual channels is not more than the predetermined critical electric potential difference, the wetting angle of the liquid on the surface of the insulating layer is not greater than the critical wetting angle. Therefore, the liquid exists on the surface of the insulating layer. However, since the meniscus is formed near the discharge port due to a surface tension of the liquid, the liquid is in a state of not being discharged from the discharge port. On the other hand, when the electric potential difference between the liquid and the individual electrode becomes less than the predetermined critical electric potential difference, the wetting angle of the liquid on the surface of the insulating layer becomes greater than the critical wetting angel, and the liquid on the surface of the insulating layer moves toward the discharge port. At this time, the meniscus near the discharge port is destroyed by the moving force of the liquid, and the liquid is discharged from the discharge port, In this case, the pressure applying unit which applies a discharge pressure to the liquid is not necessary, and the formation of the liquid transporting apparatus becomes simple.

In the liquid transporting apparatus of the present invention, the electric potential applying unit may apply selectively two types of predetermined electric potentials, which are a first electric potential and a second electric potential, to the common electrodes, and may apply selectively two types of predetermined electric potential, which are a third electric potential and a fourth electric potential, to the individual electrodes which are mutually conducted; and only when the electric potential applying unit applies the first electric potential to a certain common electrode among the common electrodes, and applies the third electric potential to an individual electrode corresponding to the certain common electrode, a potential difference between the liquid in an individual channel, to which the individual electrode is provided, and the individual electrode may become less than the critical electric potential difference.

This liquid transporting apparatus, by applying selectively by the electric potential applying unit, the two types of electric potential namely the first electric potential and the second electric potential to the common electrode, and by applying selectively the two types of electric potential namely the third electric potential and the fourth electric potential to the individual electrode, reduces the electric potential difference between the liquid and the individual electrode in the desired individual channel to be less than the critical electric potential difference, and increases the wetting angle of the liquid on the insulating layer to be greater than the critical wetting angle, and transports the liquid toward the discharge port in that individual channel. Concretely, when the first electric potential is applied to the common electrodes, and when the third electric potential is applied to the individual electrodes, the electric potential difference between the liquid and the individual electrodes becomes less than the critical electric potential difference, and the wetting angle of the liquid on the insulating layer becomes greater than the critical wetting angle. Consequently, the liquid cannot exist on the surface of the insulating layer, and the liquid moves from the surface of the insulating layer toward the discharge port, and discharged from the discharge port. On the other hand, in a combination of the electric potential difference other than the one mentioned above, since the electric potential difference between the liquid and the individual electrodes becomes not less than the critical electric potential difference, and the wetting angle of the liquid on the surface of the insulating layer becomes not greater than the critical wetting angle, and the liquid on the surface of the insulating layer does not move to the discharge port, the liquid is not discharged from the discharge port in this individual channel.

In the liquid transporting apparatus of the present invention, one of the first to forth electric potentials may be ground electric potential. In this case, since the types of the electric potential applied to the common electrode or the individual electrode by the electric potential applying unit is reduced, it is possible to make simple the formation of the electric potential applying unit, and to reduce the cost, In the liquid transporting apparatus of the present invention, the first electric potential and the third electric potential may be same. According to this structure, since the types of the electric potential applied to the common electrodes or the individual electrodes by the electric potential applying unit is reduced, it is possible to make simple the formation of the electric potential applying unit, and to reduce the cost.

In the liquid transporting apparatus of the present invention, $V_2=(V_1+V_4)/2$ may be satisfied when the first electric potential is $V_1$, the second electric potential is $V_2$, and the fourth electric potential is $V_4$. In this case, since it is possible to secure a minimum electric potential difference of $|V_4-V_1/2$ between the electric potential difference between the liquid and the individual electrodes in the individual channels in which the liquid is transported (the difference between the first electric potential and the third electric potential=0), and the electric potential difference between the liquid and the individual electrode in the individual channel in which the liquid is not transported (the difference between the first electric potential and the fourth electric potential, the difference between the second electric potential and the third electric potential, and the difference between the second electric potential and the fourth electric potential), it is possible to perform stably the liquid transporting operation and the (liquid transporting) stopping operation.

In the liquid transporting apparatus of the present invention the first electric potential and the third electric potential may be ground electric potential, or the second electric potential may be ground electric potential. In these case, since the types of the electric potential applied to the common electrodes or the individual electrodes by the electric potential applying unit becomes two types, it is possible to make simple the formation of the electric potential applying unit.

The liquid transporting apparatus of the present invention, may further include a common liquid-inflow section which is provided on an upstream of the common channels, and which communicates with the common channels; and partition walls each of which defines one of the common channels and each of which is extended up to a position between the common electrodes provided to the common channels. In this case, since the common channels communicate with the common liquid inflow section, it is possible to supply the liquid to the liquid channels at a time from the common liquid in flow channel. However, since the common channels communicate mutually via the liquid-inflow section in common, according to a formation of the liquid due to an electric potential difference of the liquid between the adjacent common channels (electric potential difference of the adjacent common electrode), there is a possibility of a generation of a gas and an electrolysis of the liquid on a surface of the common electrode. However, since the partition wall separating the common channels is extended at least up to the adjacent common electrodes, a negative effect such as the electrolysis is suppressed to some extent.

In the liquid transporting apparatus of the present invention, a throttle having a channel area narrower than a channel area of each of the common channels may be provided to a communicating portion between the each of the common channels and the common liquid-inflow section. In this case, it is possible to suppress the negative effect such as the electrolysis caused due to the electric potential difference between the liquid in the adjacent common channels (electric potential difference between the adjacent common electrodes). Moreover, since the electric potential of the liquid in the liquid channels is suppressed from being shifted temporarily from the electric potential of the common electrodes due to an inflow and an outflow of the liquid between common channels and the common liquid inflow section, the electric potential of the liquid is stable and it is possible to perform stably a liquid transporting operation and a stopping operation.

In the liquid transporting apparatus of the present invention, through holes maybe formed in the liquid transporting head at positions each overlapping with one of the individual electrodes of the individual channels; a wiring connected to the control mechanism may be formed on a surface of the liquid transporting head opposite to the individual channels, and the individual electrodes and the wiring may be connected by an electroconductive member filled in the through holes. Moreover, through holes may be formed in the liquid transporting head at positions each overlapping with one of the common electrodes of the common channels; a wiring connected to the control mechanism may be formed on a surface of the liquid transporting head on a side opposite to the common liquid channels; the common electrodes and the wiring may be connected by an electroconductive member filled in the through holes. In any of the cases, a structure of an electrical connection between the individual electrode or the common electrode, and the wiring becomes simple, and a mechanical strength of a connecting portion is also improved.

The liquid transporting apparatus of the present invention may be a printer. In this case, a printer which has a simple structure, and a size of which can be easily reduced is provided.

According to a second aspect of the present invention, there is provided a liquid transporting head which transports a liquid having an electroconductivity, including a plurality of common channels;

a plurality of individual channel groups which correspond to the common channels respectively, and each of which has a plurality of individual channels branched from one of the common channels;

a plurality of common electrodes each of which is arranged on a channel forming surface of one of the common channels, and is in direct contact with the liquid in one of the common channels;

a plurality of individual electrodes each of which is arranged on a channel forming surface of one of the individual channels; and an insulating layer which is arranged to cover each of the individual electrodes, and in which a wetting angle of the liquid on a surface of the insulating layer is decreased to be not more than a critical wetting angle at which the liquid is remainable on the surface thereof, when an electric potential difference between the liquid in the individual channels and the individual electrodes is not less than a predetermined critical electric potential difference. An individual electrode among the individual electrodes provided to an individual channel among the individual channels of one of the individual channel groups corresponds to another individual electrode provided to another individual channel of another individual channel group, and the corresponding individual electrodes are mutually conducted.

According to the second aspect of the present invention, in the liquid transporting head, it is possible to transport the liquid in the individual channels by using an electrowetting phenomenon in which the wetting angle of the liquid on the surface of the insulating layer is changed due to an electric potential difference between the liquid (common electrodes) and the individual electrodes. Consequently, as compared to conventional liquid transporting apparatuses such as ink-jet heads, a structure of the liquid channels and a structure of an actuator which transports the liquid, become simple. In addition, it is possible to arrange the liquid channels highly densely, and to reduce a size of the liquid transporting head. Moreover, as compared to the conventional actuator which applies the pressure by deformation of a piezoelectric element when the electric field is generated, it is possible to transport the ink in the individual channel at a lower drive voltage. Furthermore, since the individual electrodes corresponding between the liquid channels are in conduction, it is possible to apply commonly a predetermined electric potential by one wiring, to the individual electrodes which are in mutual conduction. Therefore, it is possible to reduce the number of wirings connected to the individual electrode, and to reduce the cost of the electrical system.

DETAILED DESCRIPTION OF THE PREFERRED EMBODIMENTS

Figure 1:
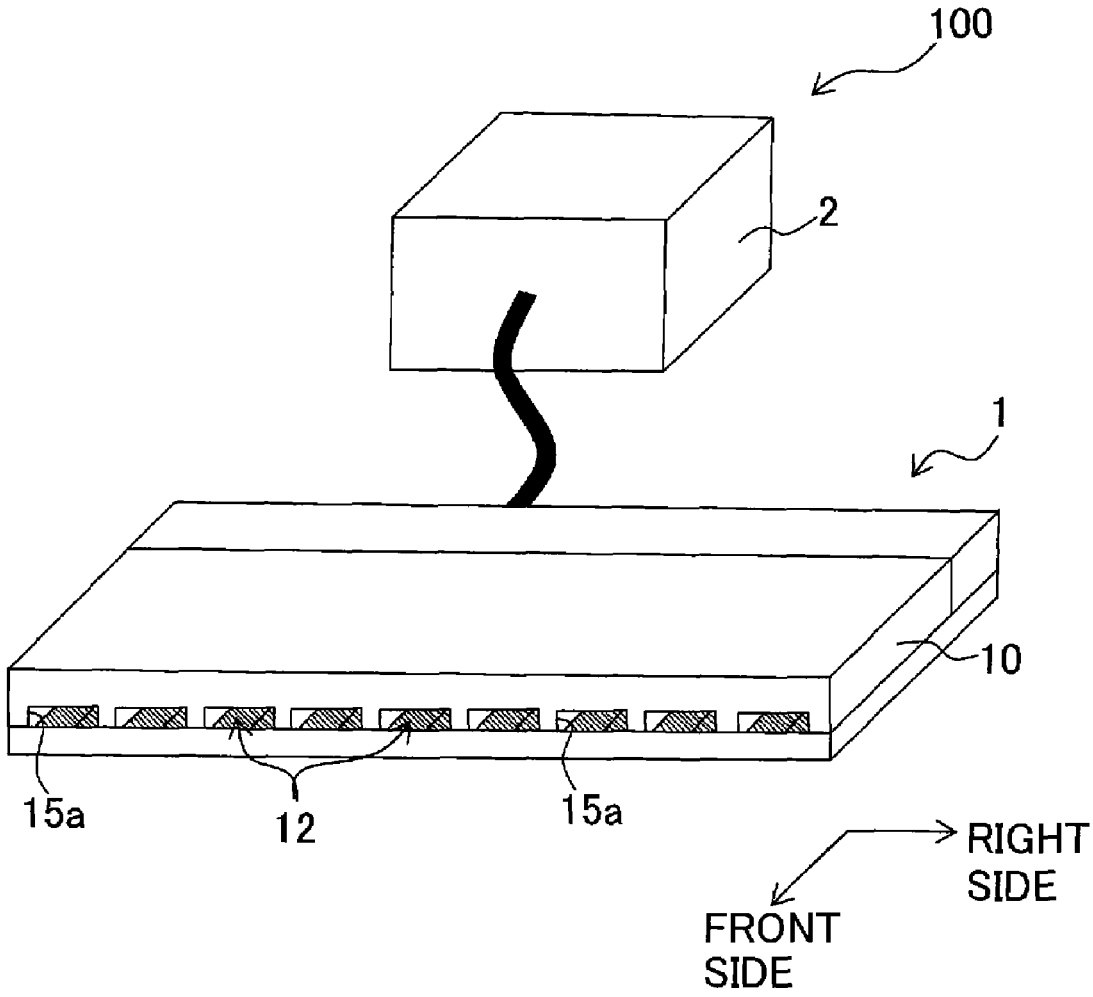
FIG. 1 is a schematic structural diagram of a printer according to a first embodiment of the present invention.

A first embodiment of the present invention will be described below by referring to FIG. 1 to FIG. 12. The first embodiment is an example in which the present invention is applied to a printer which prints (an image) on a recording paper by transporting an ink. As shown in FIG. 1, a printer 100 includes an ink transporting head 1 (liquid transporting head) which includes ink channels 12 including discharge ports 15*a*, an ink tank 2 which is connected to the ink transporting head 1 via a tube 4, and a control unit 3 (refer to FIG. 3) which controls a transporting operation of the ink in the ink transporting head 1. Moreover, the printer 100 makes each of the discharge ports 15*a* of the ink transporting head 1 discharge the ink toward a recording paper P positioned at a front side (refer to FIG. 7 to FIG. 12), and records a desired image on the recording paper P. The description will be made by defining a forward direction, a backward direction, a left direction, and a right direction in FIG. 1 as forward, backward, left, and right directions respectively.

Figure 2:
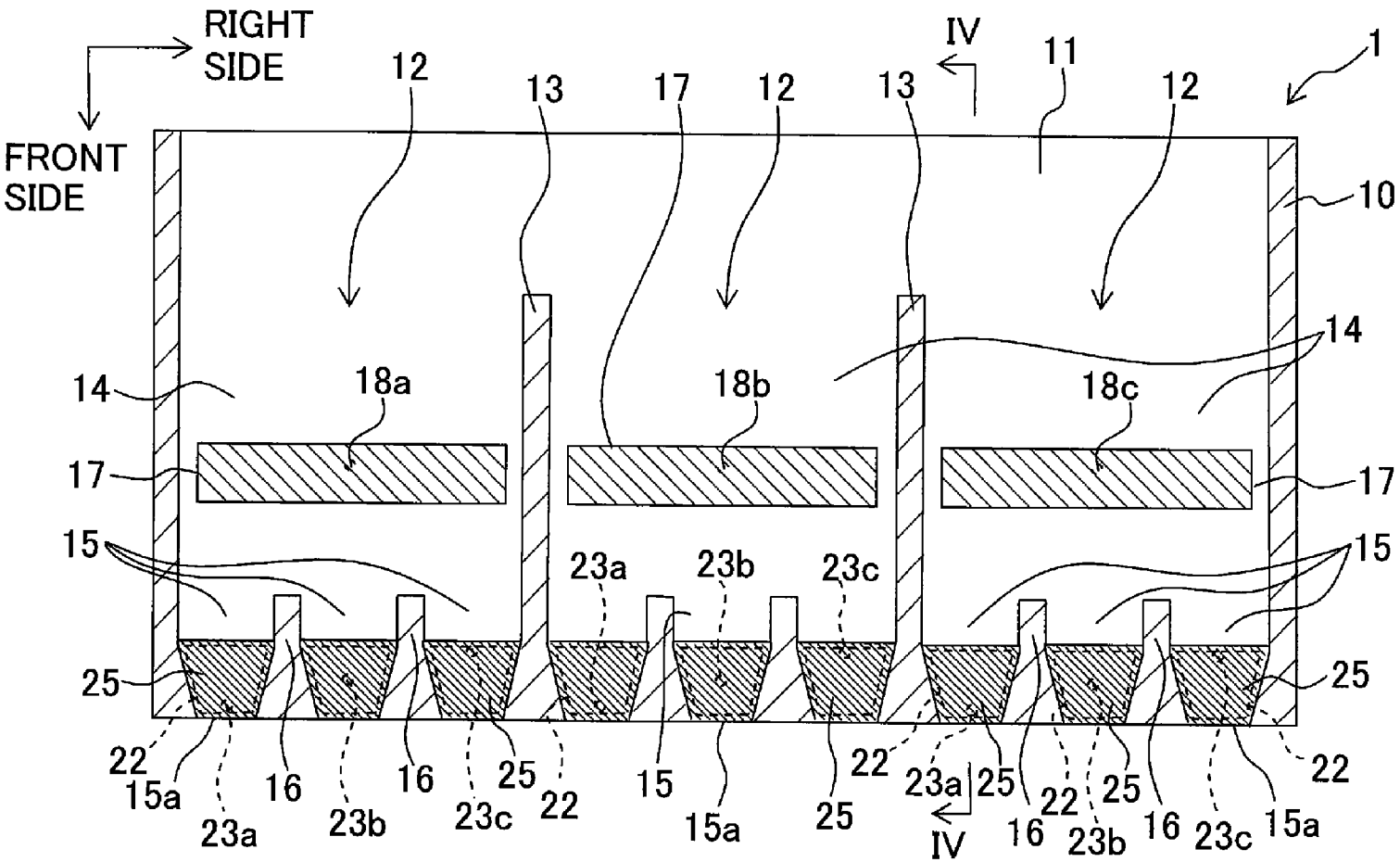
FIG. 2 is a horizontal cross-sectional view of an ink transporting head.
Figure 3:
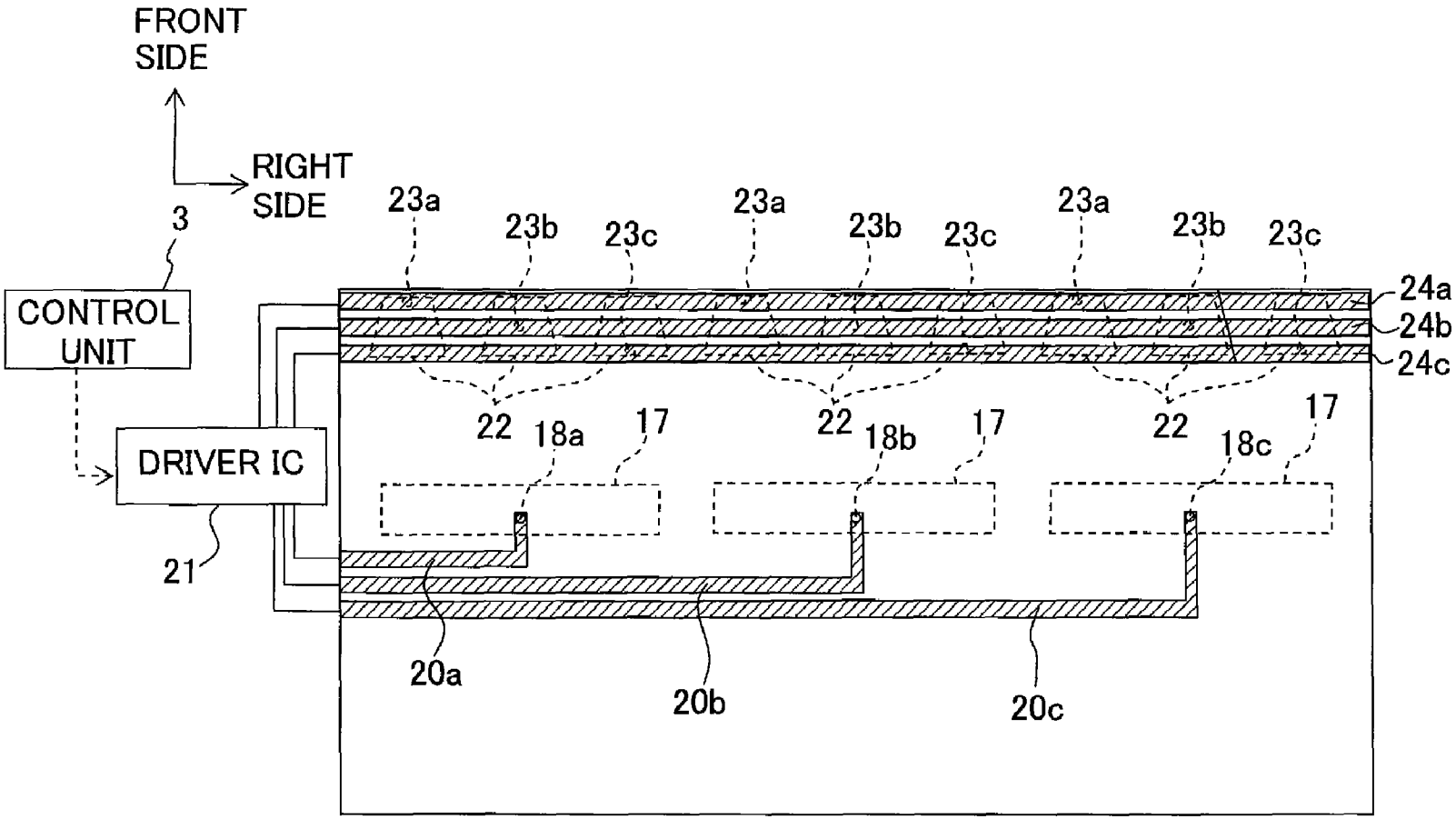
FIG. 3 is a bottom view of the ink transporting head.
Figure 4:
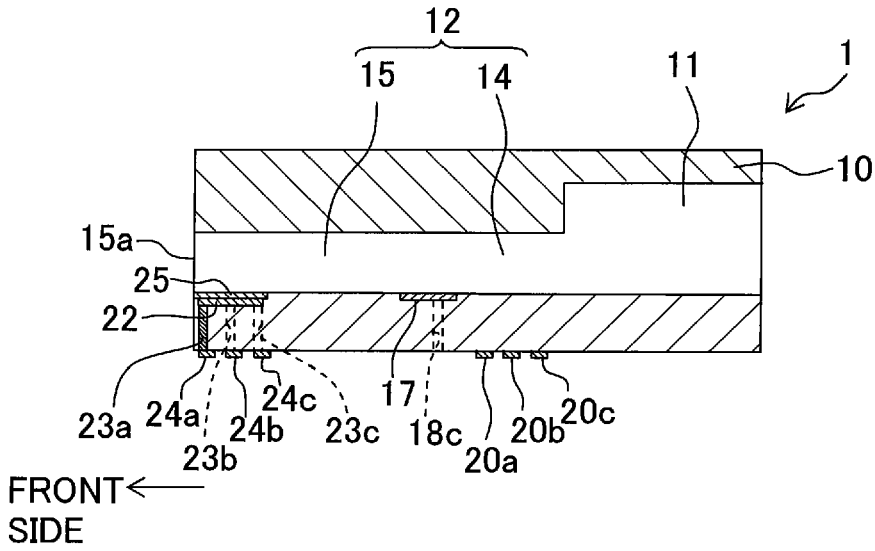
FIG. 4 is a cross-sectional view taken along a line VI-VI shown in FIG. 2.

As shown in FIG. 2 to FIG. 4, the ink transporting head 1 has a head main body 10 which forms an outer casing of the ink transporting head 1, and this head main body 10 is formed in a form of a long block (hexahedron, rectangular solid) which is longer horizontally. Inside this head main body 10, an ink inflow section (liquid inflow section) 11 which is extended in a longitudinal direction of the head main body 10, and three ink channels 12 branched from the ink inflow section 11, each extended in a forward direction are formed. An ink used in this ink transporting head 1 is an electroconductive ink such as an aqueous dye ink having water as a main constituent to which a dye and a solvent are added or an aqueous pigment ink which has water as a main constituent to which pigments and solvent are added.

The ink inflow section 11 is provided on an upstream side (rear side) of the three ink channels 12, and communicates with all the three ink channels 12. Moreover, the ink inflow section 11 is connected to the ink tank 2 (refer to FIG. 1). Consequently, the ink supplied from the ink tank 2 to the ink transporting head 1 is supplied to the three ink channels 12 via the ink inflow section 11. Furthermore, the ink tank 2 is arranged at a position slightly higher than the ink channels 12 in the ink transporting head 1, and a head pressure of the ink tank is applied all the time to the ink in the ink channel 12 to generate a flow toward the discharge port 15*a*. The ink tank 2 which makes the head pressure act on the ink corresponds to a pressure applying mechanism of the invention of this patent application.

The three ink channels 12 are separated mutually by partition walls 13 extended forward and backward among the three ink channels 12. Each of the ink channels 12 has a common channel 14 which communicates with the ink inflow section 11, and three individual channels (individual channel group) 15 which are branched from the common channel 14. The ink is supplied at a time from the ink inflow section 11 to the common channel 14 of the three ink channels. Moreover, the three individual channels 15 of each ink channel 12 are separated mutually by partition walls 16 extended forward and backward among the three individual channels 15. Furthermore, a front end portion of each individual channel 15 is formed to be a tapered shape in a plan view, and at a front end of the taper, the discharge port 15*a* opened toward the front side is provided. As shown in FIG. 1 and FIG. 2, the plurality of discharge ports 15*a* is arranged in a row in a left and right direction (horizontal direction) on a front surface of the head main body 10.

on a bottom surface (channel forming surface) of each common channel 14, a common electrode 17 which is rectangular shaped in a plan view, and extended over almost entire area in a width direction of the common channel 14 is formed, and the electroconductive ink in the common channel 14 is always in contact with the common electrode 17. As shown in FIG. 2, positions of the three common electrodes 17 related to the forward and backward direction are mutually equivalent (same). Moreover, in the head main body 10, three through holes 18*a*, 18*b*, and 18*c* each extended from an area on an upper surface of the three common channels 14, on which the common electrode 17 is formed up to a lower Surface of the head main body 10 are formed, and an electroconductive material is filled in each of these through holes 18*a*, 18*b*, and 18*c*. Furthermore, on the lower surface of the head main body 10, three wirings 20*a*, 20*b*, and 20*c* extended from the three through holes 18*a*, 18*b*, and 18*c*, along a longitudinal direction (left and right direction) of the head main body 10, up to the end portions thereof are formed. Moreover, as shown in FIG. 3, the three common electrodes 17 are connected a driver IC 21 (electric potential applying unit) which is a driving circuit, via the electroconductive material in the three through holes 18*a*, 18*b*, and 18*c*, and the wirings 20*a*, 20*b*, and 20*c*, and from the driver IC 21, one of two predetermined electric potentials (a first electric potential $V_1$, and a second electric potential $V_2$ which will be described later) is applied selectively to each common electrode 17.

On a bottom surface (channel forming surface) of the tapered front end portions of the three individual channels 15 branched from each common channel 14, three individual electrodes 22 having a trapezoidal shape in a plan view are formed to cover almost an entire bottom surface area of the front end portion. Moreover, in the head main body 10, on a front end portion of the individual channel 15 on which the individual electrode 22 is formed, a plurality of through holes 23*a*, 23*b*, and 23*c* extended up to the lower surface of the head main body 10 are formed, and the electroconductive material is also filled in these through holes 23*a*, 23*b*, and 23*c*. Here, among the three individual channels 15 branched from each common electrode 17, positions at which the through holes 23*a*, 23*b*, and 23*c* are formed are misaligned mutually in forward and backward direction. In other words, as shown in FIG. 2, in the individual channel 15 at a left end, the through hole 23*a* is formed at a position overlapping with a front end portion of the individual electrode 22. Moreover, in the individual channel 15 at a center, the through hole 23*b* is formed at a position overlapping with a central portion of the individual electrode 22. Furthermore, in the individual channel 15 at a right end, the through hole 23*c* is formed at a position overlapping with a rear end portion of the individual electrode 22.

Further, as shown in FIG. 3, on the lower surface of the head main body 10, three wirings 24*a*, 24*b*, and 24*c*, each extended along the longitudinal direction of the head main body 10, with a position in the forward and backward direction connecting the through holes 23*a*, 23*b*, and 23*c* mutually, are formed. Moreover, the three individual electrodes 22 provided to each ink channel 12 correspond respectively to the three individual electrodes 22 provided at the same positions in another ink channel 12, and the corresponding individual electrodes 22 are in mutual conduction via the electroconductive material filled in the through holes 23*a*, 23*b*, and 23*c*, and the wirings 24*a*, 24*b*, and 24*c*.

Concretely, as shown in FIG. 3, regarding the three ink channels 12, the three individual electrodes 22 positioned at a left end communicate mutually via the wiring 24*a*, the three individual electrodes 22 positioned at a central position communicate mutually via the wiring 24*b*, and the three individual electrodes 22 positioned at a right end are in mutual conduction by the wiring 24*c*. Furthermore, the individual electrodes 22 in mutual conduction are connected to the driver IC 21 (electric potential applying unit) as the driving circuit via the wirings 24*a*, 24*b*, and 24*c* respectively. Moreover, from the driver IC 21, one of two predetermined electric potentials (third electric potential $V_3$ and fourth electric potential $V_4$ which will be described later) is applied commonly to the individual electrodes 22 which are in mutual conduction. According to such formation, even when the number of the wirings for the common electrodes 17 and the number of the wirings for the individual electrodes 22 are summed up, the number of wirings becomes six, and it is possible to reduce the number of wirings as compared to a case in which a wiring is provided independently to each of nine individual electrodes 22 (number of wirings is nine).

As shown in FIG. 2 and FIG. 4, on a surface of each individual electrode 22, an insulating layer 25 made of a fluororesin is provided so as to cover the individual electrode 22 entirely. The insulating layer 25 can be formed by coating the fluororesin on the surface of the individual electrode 22 by a method such as a spin coating method.

Figure 5:
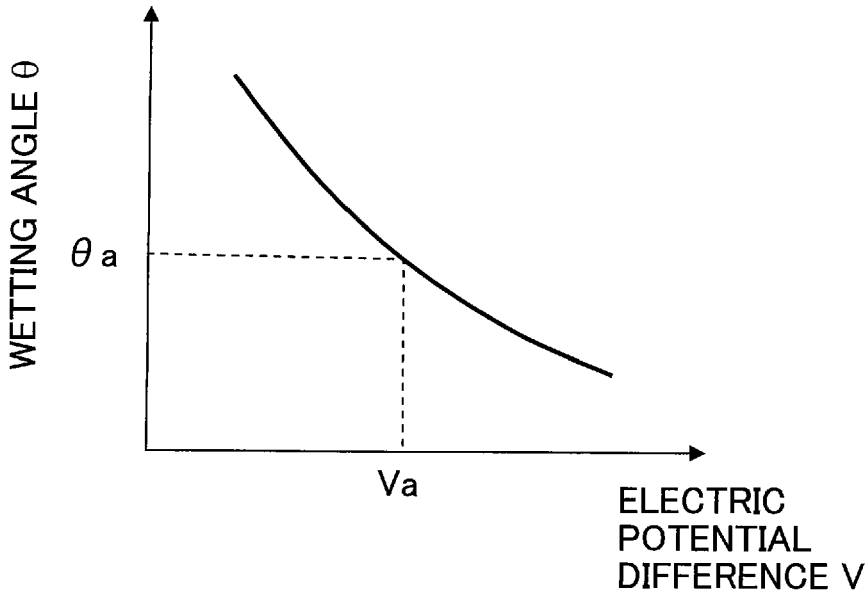
FIG. 5 is a diagram showing a relation between an electric potential difference between an ink and an individual electrode, and a wetting angle θ of the ink on a surface of an insulating layer covering the individual electrode.

Here, a wetting angle θ of the ink on a surface of the insulating layer 25 is greater than a wetting angle of the ink an inner surface of the individual channel 15 in an area in which the insulating layer 25 is not formed, when there is no electric potential difference between the ink and the individual electrode 22. Then the ink cannot exist on the surface of the insulating layer 25 (refer to FIG. 7 and FIG. 8). However, when a predetermined electric potential is applied to each of the common electrodes 17 and the individual electrodes 22, and as the electric potential difference is generated between the ink in the individual channel 15, and the individual electrodes 22 (in other words, between the individual electrode 22 and the common electrode 17 which is in contact with the ink), due to the electric potential difference, a surface energy between the ink and the insulating layer 25 is changed, and with the change in the surface energy, the wetting angle of the ink on the surface of the insulating layer 25 is changed. In other words, as shown in FIG. 5, as the electric potential difference V between the ink and the individual electrode 22 is increased, the wetting angle θ of the surface of the insulating layer 25 is decreased (electrowetting phenomenon).

Moreover, the head pressure of the ink tank 2 is applied all the time to the ink in each individual channel 15 to generate a flow toward the discharge port 15*a*. Furthermore, for a certain individual channel 15, when the electric potential difference V between the ink and the certain individual electrode becomes not less than a critical electric potential difference Va shown in FIG. 5, the wetting angle θ of the surface of the insulating layer 25 is decreased up to a critical wetting angle θa or less. At this time, the ink may exist (the ink is remainable) on the surface of the insulating layer 25, and a meniscus of the ink which remained at an edge of the insulating layer 25 is pushed to the discharge port 15*a*. Further, for that individual channel 15, the ink is moved toward the discharge port 15*a* across the surface of the insulating layer 25, and the ink is discharged from the discharge port 15*a* (refer to FIG. 9 to FIG. 12).

The critical wetting angle θa means a wetting angle of the ink on the insulating surface 25 when the ink starts flowing to the discharge port 15*a* across the surface of the insulating layer 25. Since the head pressure of the ink tank 2 is applied to the ink I in the individual channel 15, and a force toward the discharge port 15*a* is exerted all the time on the ink, when the wetting angle of the ink on the insulating layer 25 becomes less than or equal to the critical wetting angle θa, the ink starts flowing toward the discharge port 15*a*. The critical wetting angle θa becomes slightly greater than a wetting angle of the ink in an area on the inner surface of the individual channel 15 on which the insulating layer 25 is not formed. Conversely, the head pressure of the ink tank 2 which is applied to the ink in the individual channel 15 is adjusted by a height (wise position) of the ink tank 2 such that when the wetting angle of the ink on the surface of the insulating layer 25 is decreased to the critical wetting angle θa or less, a magnitude of the head pressure becomes such that the ink is discharged from the discharge port 15*a* across the surface of the insulating layer 25.

Each of the three common channels 14 communicates with the ink inflow section 11. In other words, the three common channels 14 communicate mutually via the ink inflow section 11. Therefore, when different electric potentials (the first electric potential $V_1$ or the second electric potential $V_2$) are applied to the adjacent common electrodes 17, a substantial electric potential gradient is generated in the ink in the channel due to an electric potential difference between the adjacent common electrode 17, and there is a possibility of generation of a gas and an electrolysis of water in the ink at a surface of the common electrode 17. However, as shown in FIG. 2, since the partition walls 13 separating the three common channels 14 are extended up to the upstream side upon passing through the adjacent common electrodes 17, the electric potential gradient caused due to the electric potential difference between the adjacent common electrodes 17 becomes small, and a harmful effect of the electrolysis is suppressed.

Next, a control unit 3 will be described. The control unit 3 includes a CPU (Central Processing Unit), a ROM (Read Only Memory) in which various computer programs and data for controlling an overall operation of the printer 100 are stored, and a RAM (Random Access Memory) which stores temporarily data etc. processed in the CPU. Moreover, the control unit 3 is formed to control various operations of the printer 100, such as controlling the driver IC 21 which applies the electric potential to the common electrodes 17 and the individual electrodes 22, so as to discharge the ink from the desired discharge port 15*a* of the ink transporting head 1 based on external input data (data input from outside) from a PC (Personal Computer) etc., or controlling a paper feeding mechanism (omitted in the diagram) which carries a recording paper P.

Among these various operations of the printer 100, the control of the driver IC 21 will be described below in further detail. The control unit 3, by applying a predetermined electric potential to each of the individual electrode 22 and the common electrode 17 by controlling the driver IC 21, sets a predetermined electric potential difference between the ink in each individual channel 15, and the individual electrode 22 such that the ink transporting head 1 discharges the ink from the discharge port 15*a* of the desired individual channel 15, and does not discharge the ink from the discharge ports 15*a* of the individual channels 15 other than the desired individual channel 15.

As described above, among the three ink channels 12, the three corresponding individual electrodes 22 are in mutual conduction via the wirings 24*a*, 24*b*, and 24*c*. Therefore, as compared to a case in which the wirings are provided independently to each individual electrode 22, it is possible to reduce the number of wirings, and to reduce the cost of the electrical system. However, in this formation, irrespective of whether the ink is discharged or not, the same electric potential is applied commonly to the three individual electrodes 22 which are in mutual conduction. Therefore, when the electric potential of the common electrode 17 is kept to be a constant electric potential (ground electric potential for example), among the three individual channels 15 in which the individual electrodes are in mutual conduction, since the electric potential difference between the ink and the individual electrode 22 becomes equivalent (equal), the discharge of the ink only from the discharge port 15*a* of the desired individual channel 15 becomes impossible.

Consequently, the control unit 3 of the first embodiment can make the driver IC 21 apply selectively any one of the predetermined electric potentials namely the first electric potential $V_1$ and the second electric potential $V_2$ to each common electrode 17, and apply selectively any one of the predetermined electric potentials namely the third electric potential $V_3$ and the fourth electric potential $V_4$ to each individual electrode 22. Moreover, according a combination of the electric potentials of the common electrode 17 and the individual electrode 22, only in the desired individual channel 15, the electric potential difference not less than the critical electric potential difference Va (refer to FIG. 5) is generated between the ink and the individual electrode 22, and the ink is discharged from the discharge port 15*a* of the desired individual channel 15.

Here, these four electric potentials $V_1$ to $V_4$ are set such that at least the following relations are established. Firstly, when the first electric potential $V_1$ is applied to the common electrode 17, and the third electric potential $V_3$ is applied to the individual electrode 22, a relation $|V_3-V_1| \geqq Va$ is established so that the electric potential difference between the ink in contact with the common electrode 17, and the individual electrode 22 becomes not less than the critical electric potential difference Va. On the other hand, when (the combination of) the electric potentials of the common electrode 17 and the individual electrode 22 is other than the abovementioned combination, each of relations $|V_4-V_1|<Va$, $|V_3-V_2|<Va$, and $|V_4-V_2|<Va$ is established so that the electric potential difference between the ink and the individual electrode 22 becomes less than the critical electric potential difference Va.

Consequently, the first electric potential $V_1$ is applied from the driver IC 21 to the common electrode 17 provided to the common channel 14 communicating with the predetermined individual channel 15 for which a request for the ink discharge is made by the control unit 3, and the second electric potential $V_2$ is applied to the common electrodes 17 other than this common electrode 17 (other than the common electrode 17 to which the first electric potential $V_1$ is applied). At the same time, the third electric potential $V_3$ is applied commonly from the driver IC 21 to the three individual electrodes 22 including the individual electrode 22 provided to the predetermined individual channel 15, and the two individual electrodes 22 in conduction with this individual electrode 22 (which is provided to the predetermined individual channel 15), and the fourth electric potential $V_4$ is applied to the individual electrodes 22 other than these three individual electrodes 22. In the individual channel 15 for which the request for the ink discharge is made, since the electric potential of the ink (electric potential of the common electrode 17), and the electric potential of the individual electrode 22 become the first electric potential $V_1$ and the third electric potential $V_3$ respectively, and the electric potential difference between the ink and the individual electrode 22 becomes not less than the critical electric potential difference Va, the wetting angle of the ink on the surface of the insulating layer 25 becomes not greater than the critical wetting angle θa, and the meniscus of the ink moves to the discharge port 15*a*, and the ink is discharged from this discharge port 15*a*. On the other hand, in the individual channels 15 other than this individual channel 15, since the electric potential difference between the ink and the individual electrode 22 becomes less than the critical electric potential difference Va, the wetting angle of the ink on the surface of the insulating layer 25 becomes greater than the critical wetting angle θa. Therefore, the meniscus cannot move to the discharge port 15*a*, and the ink is not discharged from the discharge port 15*a*. Consequently, only in the predetermined channel 15 for which the request of the ink discharge is made, the ink can be moved to the discharge port 15*a* and discharged. Thus, the discharge port 15*a* of the ink transporting head 1 is divided into a plurality of groups, and in each group, it is possible to discharge the ink from the desired discharge port 15*a*. Consequently, it is possible to drive (group drive, matrix drive) to discharge the ink from the desired discharge port 15*a* while switching one by one the groups of the discharge port 15*a* from which the ink is to be discharged.

Figure 6:
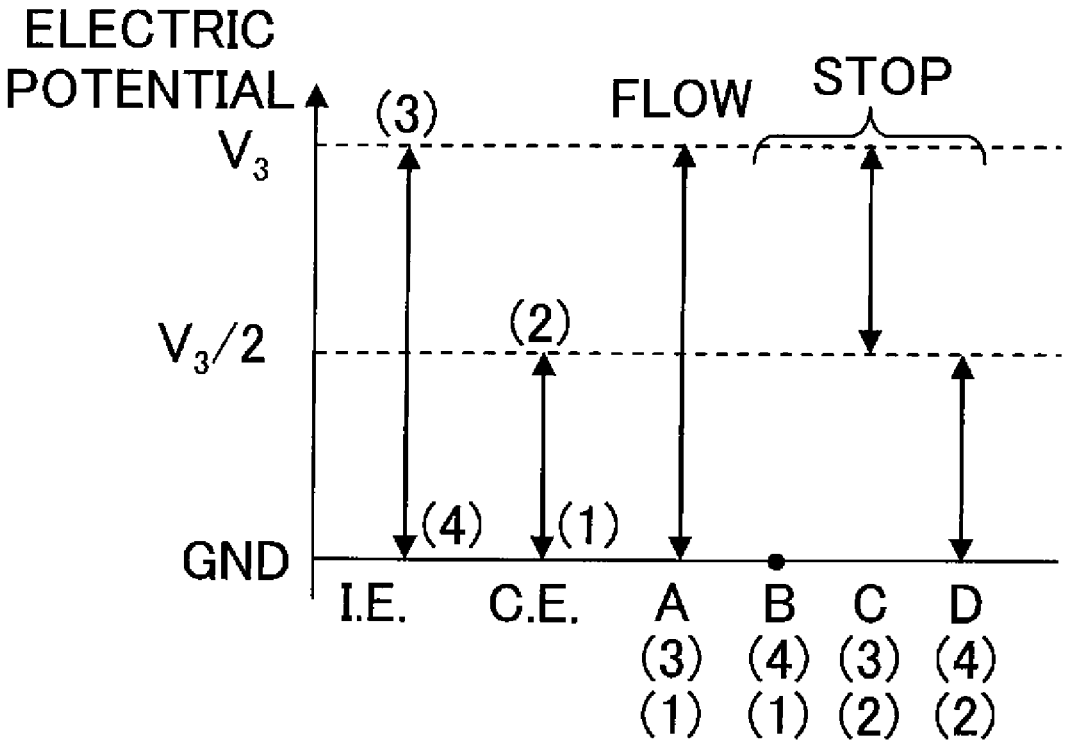
FIG. 6 is a diagram showing an example of a relation of four electric potentials $V_1$ to $V_4$ applied to a common electrode or the individual electrode of the first embodiment.

Furthermore, an example of a preferable combination of the four electric potentials $V_1$ to $V_4$ is shown in FIG. 6. In (diagrams following) FIG. 6, (1) to (4) denote the first electric potential $V_1$ and the second electric potential $V_2$ applied to the common electrode 17, and the third electric potential $V_3$ and the fourth electric potential $V_4$ applied to the individual electrode 22 respectively, and C.E. and I.E. denote the common electrodes and the individual electrodes respectively. Moreover, an electric potential difference A is an electric potential difference $|V_3-V_1|$ between the third electric potential $V_3$ and the first electric potential $V_1$, and in this combination of electric potentials, the electric potential difference between the ink and the individual electrode 22 becomes not less than the critical electric potential difference Va, and the ink flows inside the individual channel 15. On the other hand, an electric potential difference B is an electric potential difference $|V_4-V_1|$ between the fourth electric potential $V_4$ and the first electric potential $V_1$, an electric potential difference C is an electric potential difference $|V_3-V_2|$ between the third electric potential $V_3$ and the second electric potential $V_2$, and an electric potential difference D is an electric potential difference $|V_4-V_2|$ between the fourth electric potential $V_4$ and the second electric potential $V_2$, and in these combinations of the electric potentials, the electric potential difference between the ink and the individual electrode 22 becomes less than the critical electric potential difference Va, and the ink does not flow inside the individual channel 15 (stopped state).

In a relation in FIG. 6, both the first electric potential $V_1$ and the fourth electric potential $V_4$ are the ground electric potential (GND), and further, the second electric potential $V_2$ is an intermediate electric potential between the first electric potential $V_1$ and the third electric potential $V_3$. In other words, $V_2=(V_3+V_1)/2=V_3/2$. Therefore, it is possible to keep a large difference greater than or equal to V3/2 all the time between the potential difference A and the potential difference B, C or D, and to perform stably an ink transporting operation and an ink (transporting) stopping operation. Then the electric potential difference A is a potential difference between the common electrode 17 and the individual electrode 22 in the individual channel 15 which transports the ink to the discharge port 15*a*, the electric potential difference B, C, or D is a potential difference between the common electrode 17 and the individual electrode 22 in the individual channel 15 which does not transport the ink. Moreover, since the first electric potential $V_1$ and the fourth electric potential $V_4$ are the ground electric potential, types of the electric potentials applied to the common electrode 17 and the individual electrode 22 by the driver IC 21 are reduced to two types namely the second electric potential $V_2$ and the third electric potential $V_3$. Therefore it is possible to make simple the formation of the driver IC 21, and to reduce the cost thereof.

Next, an ink transporting operation (discharge operation) by the ink transporting head 1 will be described below by referring to FIG. 7 to FIG. 12. In the following description, in the combinations of the electric potentials shown in FIG. 6, the third electric potential $V_3$ is 30 V, the second electric potential $V_2$ (=$V_3$/2) is 15 V, and the critical electric potential difference Va is 25 V. Consequently, the electric potential difference $V_3-V_1$ (=30 V) between the third electric potential $V_3$ and the first electric potential $V_1$ is greater than the critical electric potential difference Va, but the electric potential difference in the other combinations of the electric potentials (for example, the electric potential difference $V_3-V_2$ (=15 V) between the third electric potential $V_3$ and the second electric potential $V_2$) is less than the critical electric potential difference Va.

Figure 7:
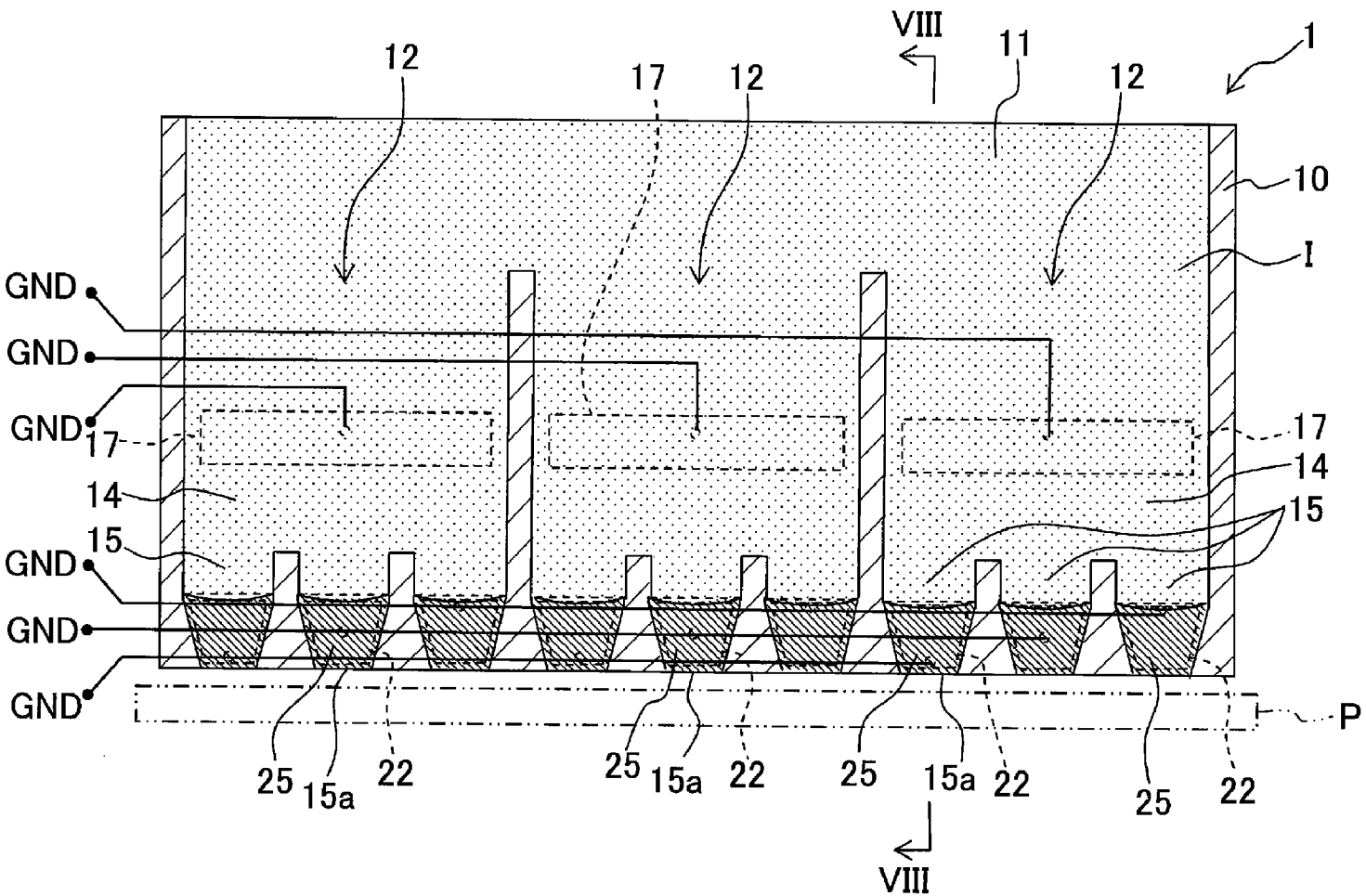
FIG. 7 is a horizontal cross-sectional view of the ink transporting head in a state of not discharging the ink.
Figure 8:
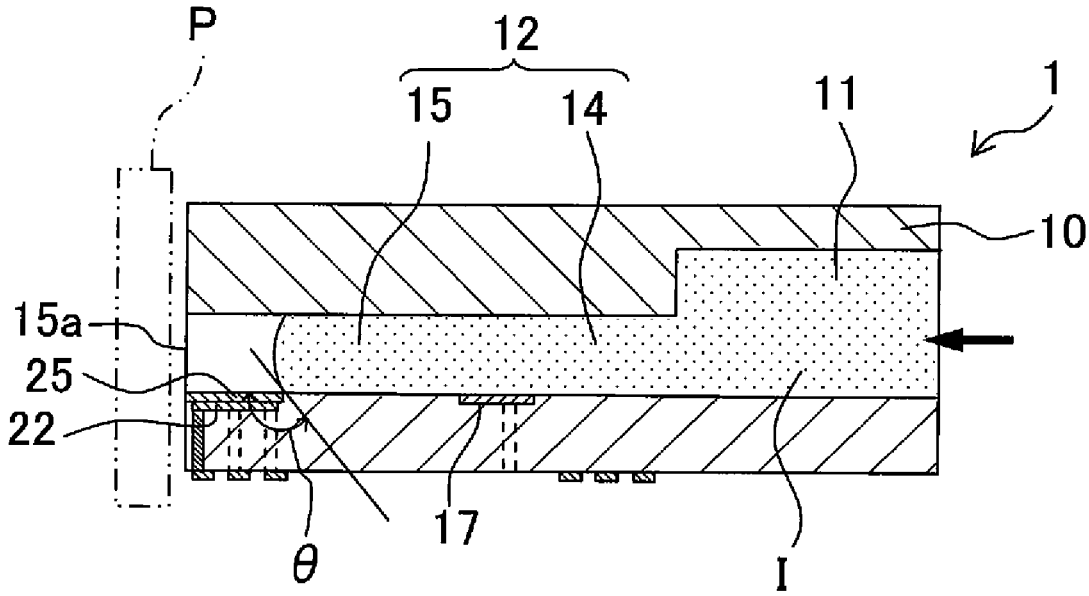
FIG. 8 is a cross-sectional view taken along a line VIII-VIII shown in FIG. 7.

As shown in FIG. 7 and FIG. 8, when all the common electrodes 17 are kept at the ground electric potential (first electric potential) and further, all the individual electrodes 22 are also kept at the ground electric potential (fourth electric potential), the electric potential difference between the ink and the individual electrode 22 in all the individual channels 15 is zero, and the electric potential difference (zero) is smaller than even the critical electric potential difference Va. Therefore the wetting angle θ of the ink I on the surface of the insulating layer 25 becomes greater than the critical wetting angle θa in FIG. 5. Accordingly, the ink I can not cross over the surface of the insulating layer 25 and move to the discharge port 15*a*, and a meniscus of the ink I is formed at an edge on a rear side of the insulating layer 25.

Figure 9:
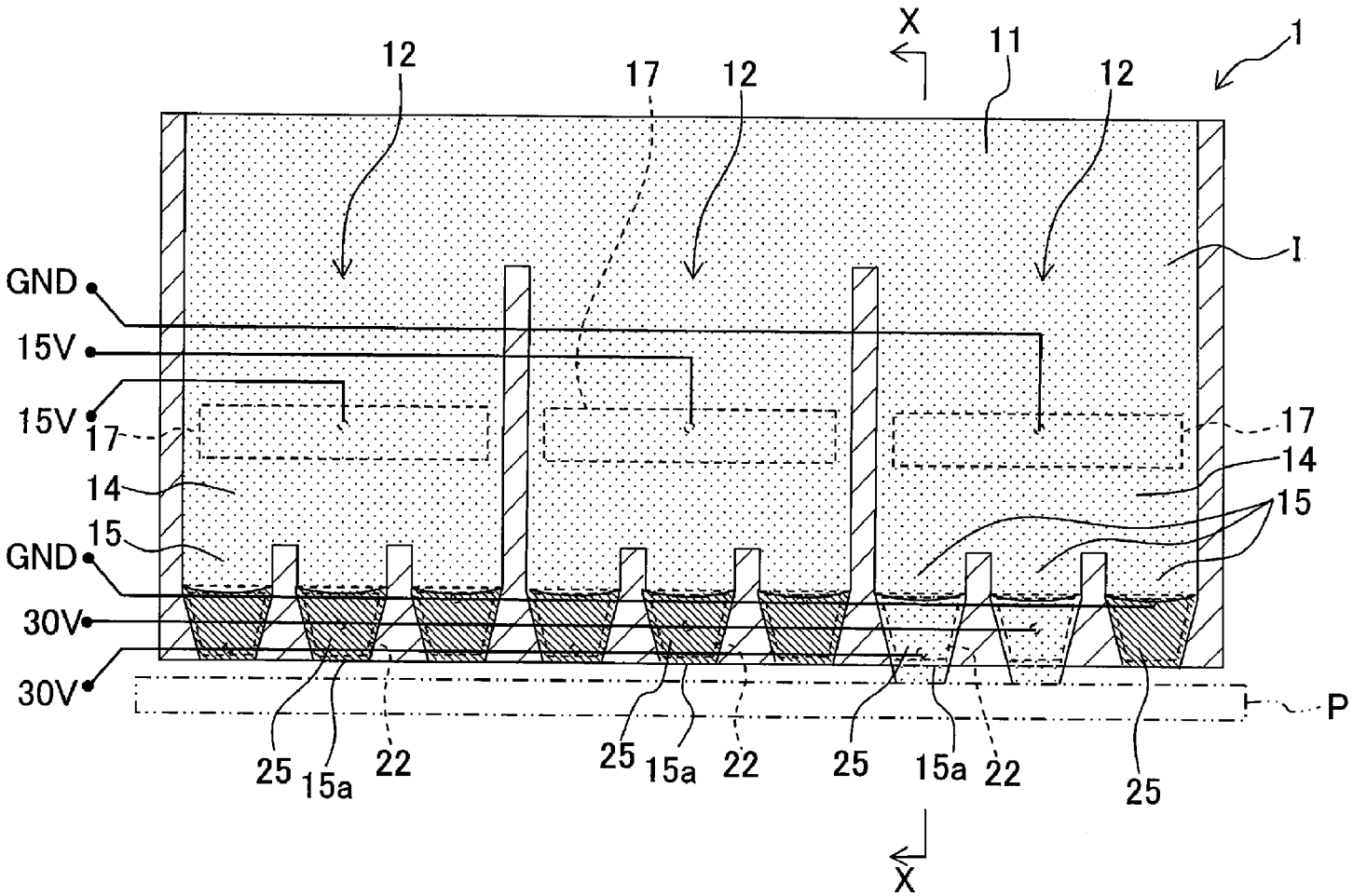
FIG. 9 is a horizontal cross-sectional view of the ink transporting head in a state of discharging the ink from a certain discharge port.
Figure 10:
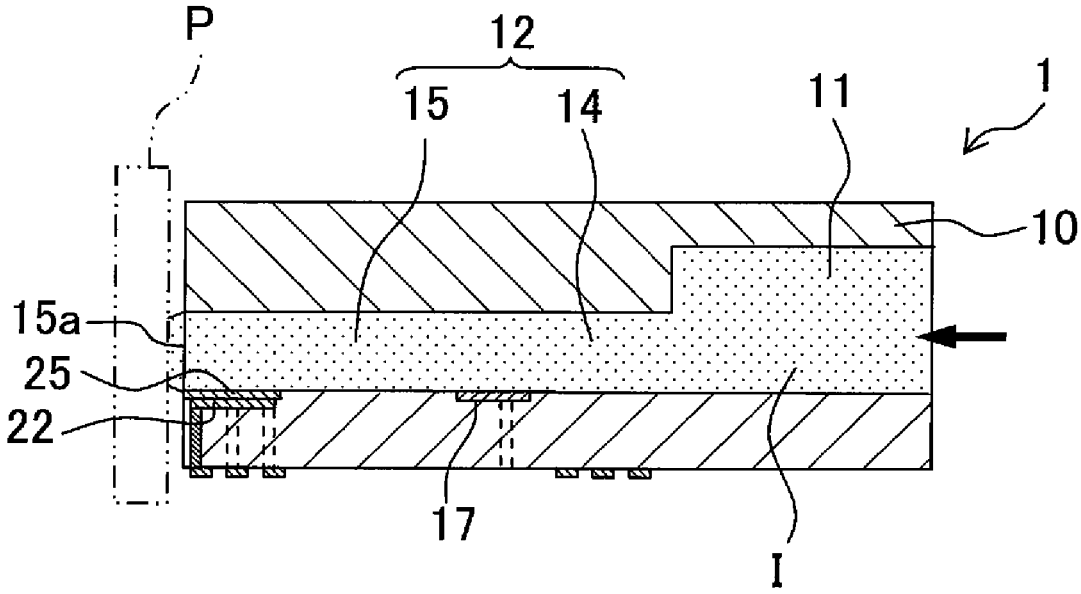
FIG. 10 is a cross-sectional view taken along a line X-X shown in FIG. 9.

From this state, as shown in FIG. 9, the electric potential (second electric potential) of 15 V is applied from the driver IC 21 to the two common electrodes 17 provided to an ink channel 12 at a left end and an ink channel 12 at a center respectively, and further, the electric potential (third electric potential) of 30 V is applied from the driver IC 21 to the two individual electrodes 22 formed on the two individual channels 15 positioned at the left end and at the center. Here, for the three ink channels 12, since the corresponding individual electrodes 22 are in mutual conduction via the wirings 24*a*, 24*b*, and 24*c*, for all the ink channels 12, (the electric potential of) 30 V is applied simultaneously to the individual electrodes 22 of the individual channels 15 positioned at the left end and the center.

At this time, in the two individual channels 15 positioned at the left end and the center in the ink channel 12 at a right end, the electric potential difference between the ink I in contact with the common electrode 17, and the individual electrode 22 becomes 30 V, which is greater than the critical electric potential difference Va. Consequently, since the wetting angle θ of the ink on the surface of the insulating layer 25 is decreased and becomes smaller than the critical wetting angle θa, the meniscus of the ink I moves to the discharge port 15*a* upon crossing over the surface of the insulating layer 25 due to the head pressure of the ink tank 2 acting from the upstream side and the ink I is discharged from the discharge port 15a to the recording paper P. On the other hand, the electric potential difference between the ink I in contact with the common electrode 17, and the individual electrode 22 becomes 15 V in the two individual channels 15 positioned at the left end and the center, of the ink channels 12 at the left end and the center. However, since this electric potential difference of 15 V is less than the critical electric potential difference Va, the wetting angle θ of the ink I on the surface of the insulating layer 25 is somewhat decreased but does not become smaller than (or equal to) the critical wetting angle θa, and the ink I cannot cross over the surface of the insulating layer 25, and move to the discharge port 15*a*. Consequently, only in the two individual channels 15 of the ink channel 12 at the right end, when the electric potential of the common electrode 17 is the ground electric potential, and when the electric potential of the individual electrode is 30 V, the ink I flows, and is discharged from the discharge port 15*a*.

Figure 11:
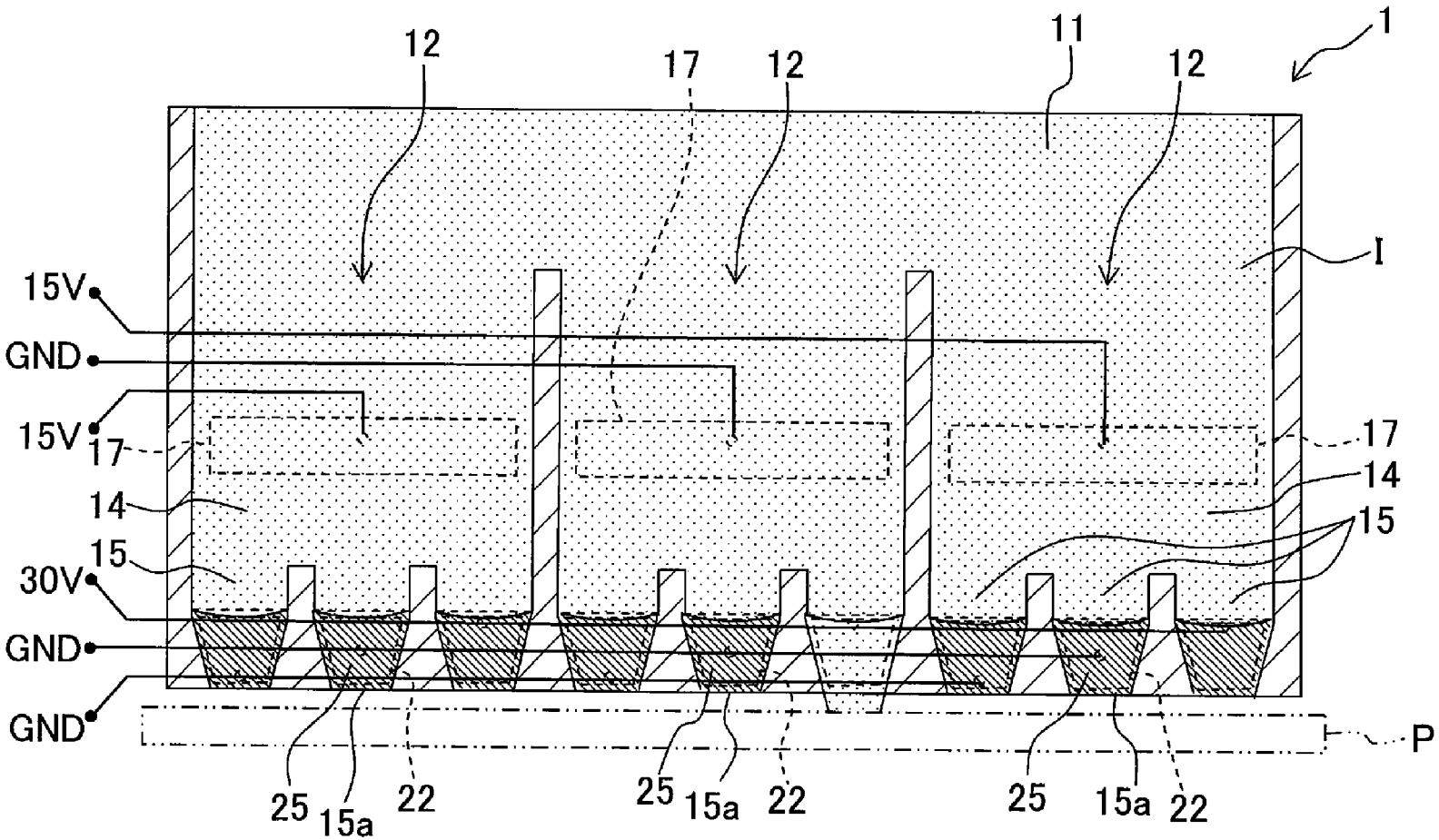
FIG. 11 is a horizontal cross-sectional view of the ink transporting head in a state of discharging the ink from another discharge port.

Next, as shown in FIG. 11, the electric potential of the common electrode 17 of the common channel 14 at the center is the ground electric potential, the electric potential of the common electrode 17 of the left and right common channel 14 (second electric potential) is 15 V, and further, the electric potential of the individual electrode 22 formed on the individual channel 15 positioned at the right end, from among the three individual channels 15 of each ink channel 12 (third electric potential) is 30 V. At this time, in the individual channel 15 positioned at the center, of the central ink channel 12, the electric potential difference between the ink and the individual electrode 22 becomes greater than the critical electric potential difference Va, and the ink is discharged from the ink port 15*a*. However, in the individual channels 15 other than this individual channel 15, since the electric potential difference between the ink and the individual electrode 22 is less than the critical electric potential difference, the ink is not discharged.

Figure 12:
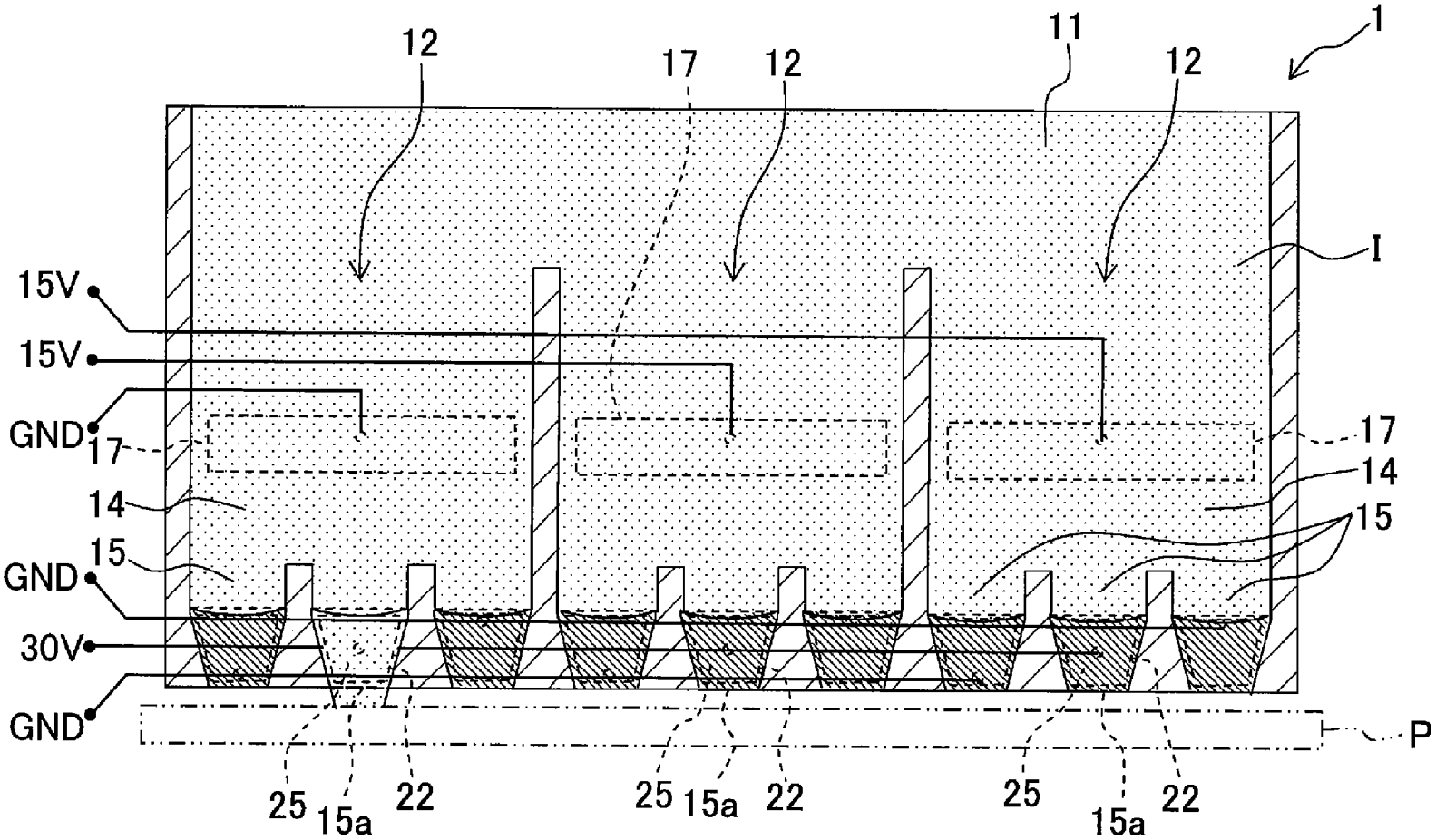
FIG. 12 is a horizontal cross-sectional view of the ink transporting head in a state of discharging the ink from still another discharge port.

Furthermore, as shown in FIG. 12, the electric potential of the common electrode 17 of the common channel 14 at the left end is the ground electric potential, the electric potential of the common electrode 17 of the common channels 14 at the right end and the center is 15 V (second electric potential), and further, the electric potential of the individual electrode formed in the individual channel 15 positioned at the center is let to be 30 V (third electric potential). In this state, the electric potential difference between the ink and the individual electrode 22 in the individual channel 15 positioned at the center becomes greater than the critical electric potential difference Va, and the ink is discharged from the discharge port 15*a*. However, in the individual channels 15 other than this individual channel 15, since the electric potential difference between the ink and the individual electrode 22 is less than the critical electric potential difference Va, the ink is not discharged.

According to the printer 100 of the first embodiment which is described above, the following effects are achieved. The ink transporting head 1 can transport the ink in the individual channel 15 to the discharge port 15*a* by changing the wetting angle of the ink on the surface of the insulating layer 25 by setting appropriately the electric potential difference between the common electrode 17 in contact with the ink, and the individual electrode 22. Therefore, as compared to the conventional ink-jet heads, a structure of the ink channels and a structure of an actuator which transports the ink become simple. Moreover, it is possible to arrange the ink channels in the (ink transporting) head even more highly densely, and to reduce a size of the ink transporting head 1. Furthermore, as compared to the conventional actuator which applies the pressure by deformation of a piezoelectric element when an electric field is generated, it is possible to transport the ink in the individual channel 15 at even lower drive voltage.

Since the three individual electrodes 22 corresponding between the three ink channels 12 are in mutual conduction, it is possible to apply commonly the predetermined electric potential by one wiring to the three individual electrodes which are in mutual conduction. Therefore, it is possible to reduce the number of wirings connected to the individual electrodes 22, and to reduce the cost of the electrical system, According to such formation, irrespective of whether the ink is discharged or not, the same electric potential is applied commonly to the three individual electrodes 22 corresponding between the three ink channels 12. However, in the printer of the first embodiment, since the driver IC 21 controlled by the control unit 3 applies selectively one of the predetermined electric potentials namely the first electric potential $V_1$ and the second electric potential $V_2$ to each individual electrode 17, and applies selectively one of the predetermined electric potentials namely the third electric potential $V_3$ and the fourth electric potential $V_4$, it is possible to realize the matrix drive described above Therefore, only in the desired individual channel 15, it is possible to discharge the ink from the discharge port 15*a* thereof by reducing the wetting angle of the ink on the insulating layer 25 to be smaller than or equal to the critical wetting angle θa by letting the electric potential difference between the ink and the individual electrode 22 to be not less than the critical electric potential difference Va.

The head pressure of the ink tank 2 is applied all the time to the ink in the ink channel 12 to generate the flow of the ink toward the discharge port 15*a*. Therefore the ink is discharged assuredly from the discharge port 15*a*, when the electric potential difference between the ink and the individual electrode 22 is increased and the wetting angle of the ink on the surface of the insulating layer 25 becomes smaller than or equal to the critical wetting angle θa.

Next, modified embodiments in which various modifications are made in the first embodiment will be described. Same reference numerals are assigned to the components having the same structure as in the first embodiment, and the description of such components is omitted.

First Modified Embodiment

Figure 13:
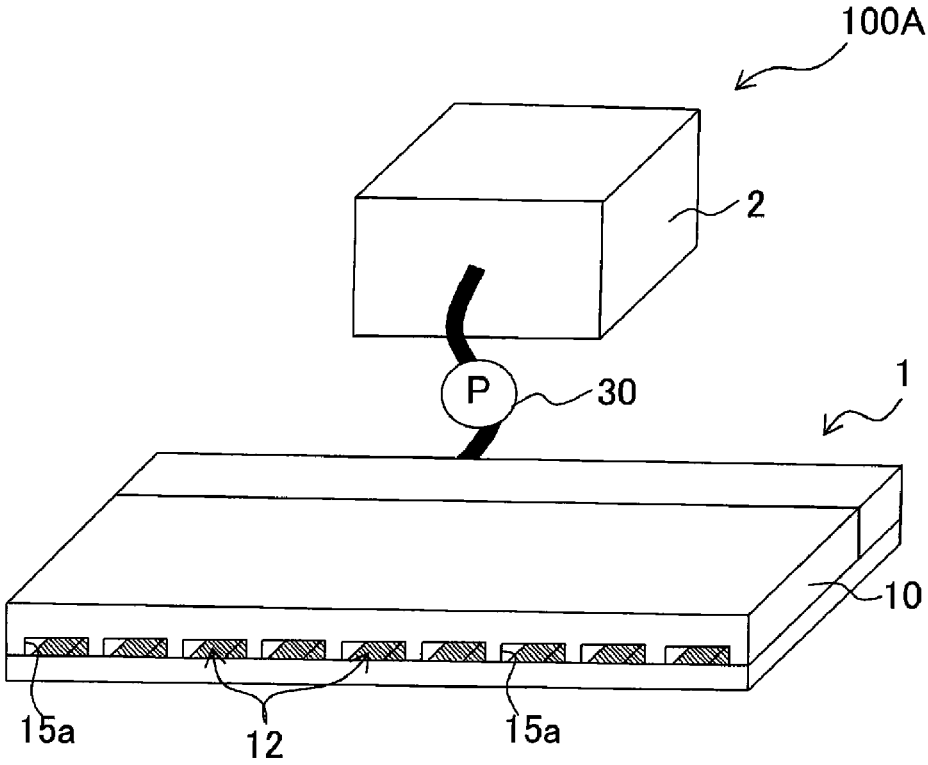
FIG. 13 is a schematic structural diagram of a printer of a first modified embodiment of the first embodiment.

As shown in FIG. 13, a printer 100A may be formed such that the printer 100A includes a pressurizing pump (a booster pump) 30 (pressure applying unit) between the ink tank 2 and the ink transporting head 1, and a pressure is applied to the ink in the ink transporting head 1 to generate a flow of the ink toward the discharge port 15*a*, by supplying the ink pressurized by the pressurizing pump 30, to the ink transporting head 1. In this formation, when the electric potential difference between the ink and the individual electrode 20 becomes greater or equal to the critical electric potential difference, the ink is discharged assuredly from the discharge port 15*a*.

Second Modified Embodiment

The combinations of the four electric potentials $V_1$, to $V_4$ are not restricted to the combinations shown in FIG. 6 of the first embodiment, and can take various values provided that the relations mentioned above ($|V_3-V_1| \geqq Va$, $|V_4-V_1|<Va$, $|V_3-V_2|<Va$, and $|V_4-V_2|<Va$) are satisfied. Some preferable examples from among the combinations of these four electric potentials $V_1$ to $V_4$ will be described below.

First and Second Examples

Figure 14:
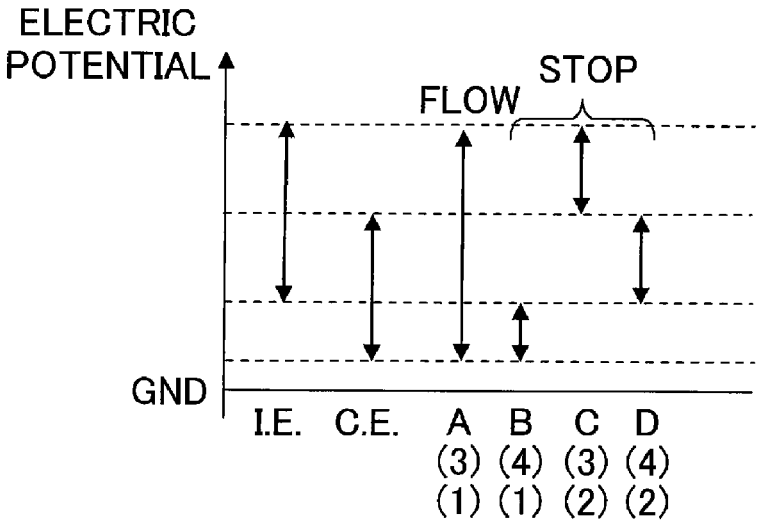
FIG. 14 is a diagram showing a relation of four electric potentials $V_1$ to $V_4$ in a first example of a second modified embodiment.
Figure 15:
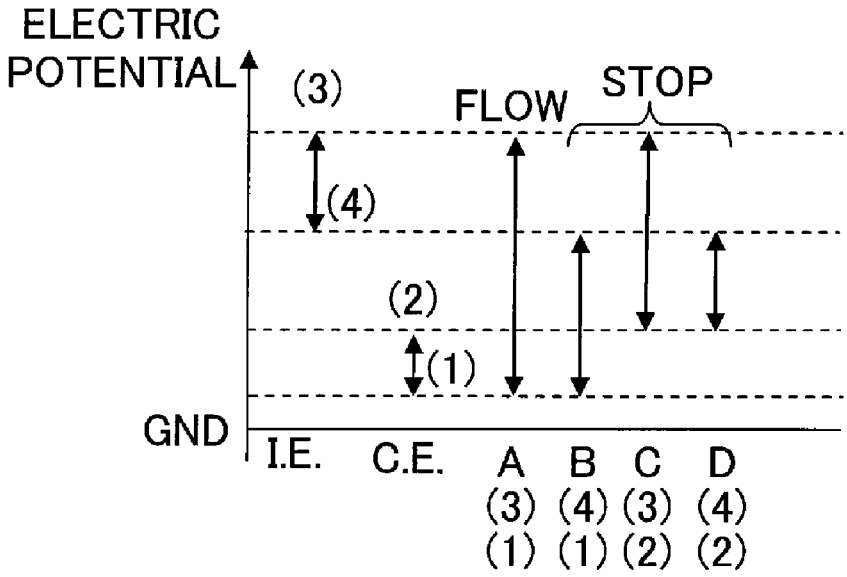
FIG. 15 is a diagram showing a relation of four electric potentials $V_1$ to $V_4$ in a second example of the second modified embodiment.

As shown in FIGS. 14 and 15, all the four electric potentials $V_1$ to $V_4$ may be positive electric potentials higher than the ground electric potential, and among these four electric potentials $V_1$ to $V_4$, the third electric potential $V_3$ may be maximum and the first electric potential $V_1$ may be minimum. In this case, the electric potential difference A between the common electrode 17 and the individual electrode 22, in the individual channel 15 which transports the ink to the discharge port 15*a*, is increased. Therefore, it is possible to change substantially the electric potential difference A against the electric potential difference B, C and D between the common electrode 17 and the individual electrode 22 in the individual channel 15 which does not transport the ink, and to perform stably the ink transporting operation and the stopping operation. Conversely, even in a case in which the first electric potential $V_1$ is maximum and the third electric potential $V_3$ is minimum, an effect similarly as in FIG. 14 and FIG. 15 is achieved. Moreover, even when all the electric potentials $V_1$ to $V_4$ are negative electric potentials lower than the ground electric potential, the similar effect is achieved.

Third Example

Figure 16:
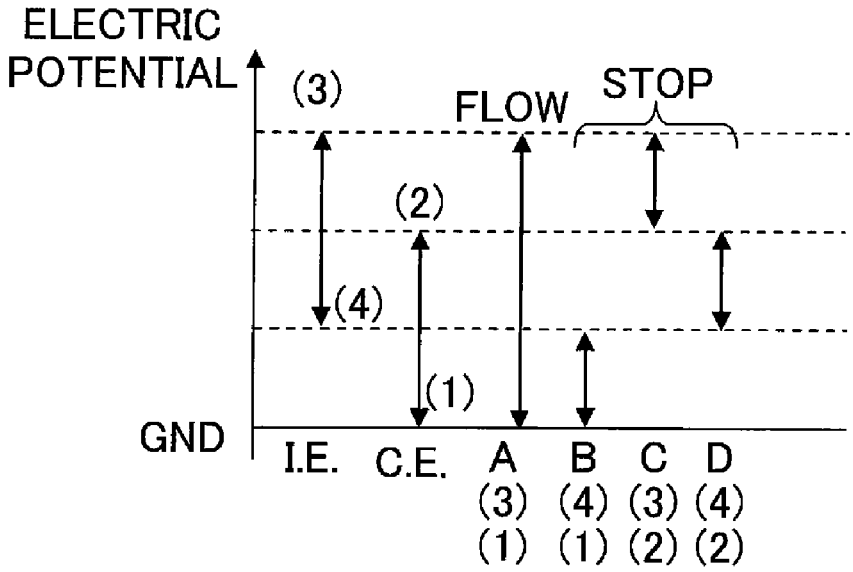
FIG. 16 is a diagram showing a relation of four electric potentials $V_1$ to $V_4$ in a third example of the second modified embodiment.

Any one of the four electric potentials $V_1$ to $V_4$ may be the ground electric potential. For example, in FIG. 16, the first electric potential $V_1$ is the ground electric potential. In this case, since the number of types of electric potentials applied to the common electrode 17 and the individual electrode 22, from the driver IC 21 are reduced to three, it is possible to make simple the formation of the driver IC 21, and to reduce the cost of electronic components including the driver IC 21.

Fourth and Fifth Examples

Figure 17:
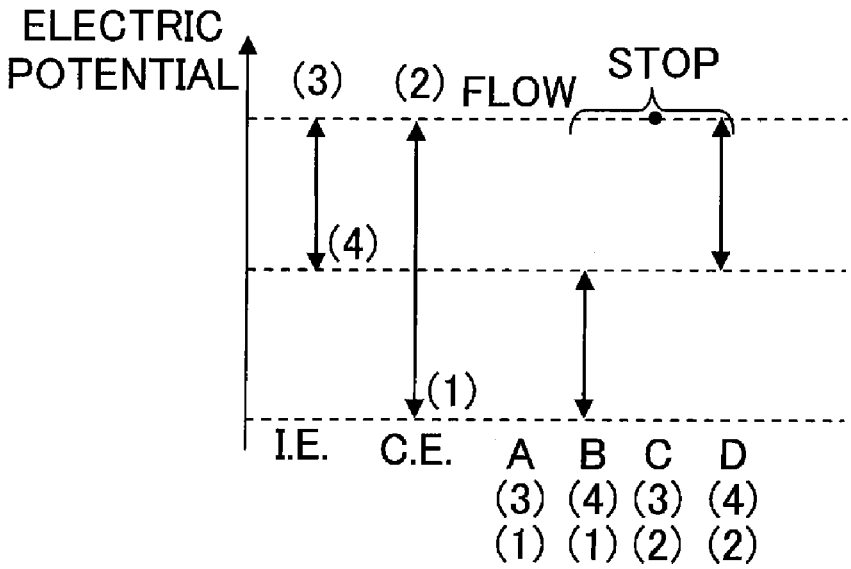
FIG. 17 is a diagram showing a relation of four electric potentials $V_1$ to $V_4$ in a fourth example of the second modified embodiment.
Figure 18:
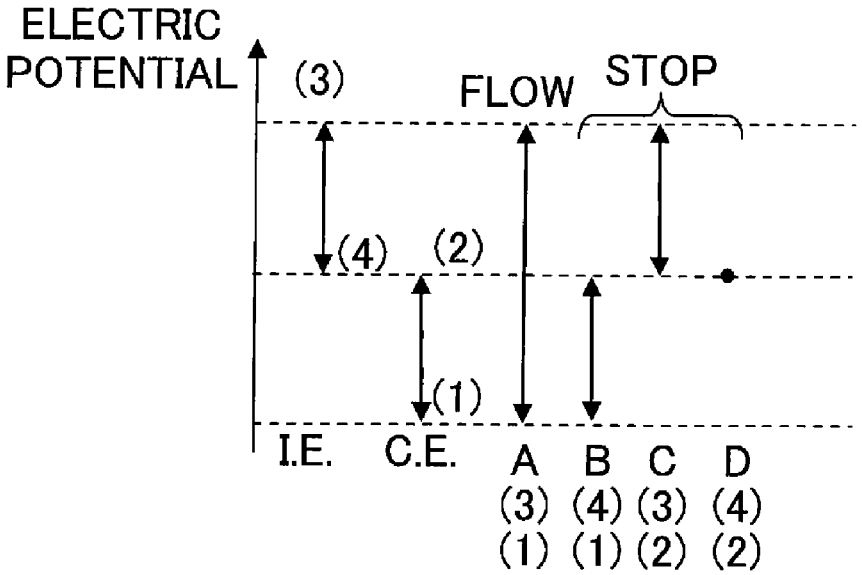
FIG. 18 is a diagram showing a relation of four electric potentials $V_1$ to $V_4$ in a fifth example of the second modified embodiment.

In the first embodiment, the first electric potential $V_1$, and the fourth electric potential $V_4$ were the same electric potentials (refer to FIG. 6), but as shown in FIG. 17 and FIG. 18, the second electric potential $V_2$ and the third electric potential $V_3$, or the second electric potential $V_2$ and the fourth electric potential $V_4$ may be the same electric potentials. In this case also, since the number of types of the electric potentials applied to the common electrode 17 and the individual electrode 22 from the driver IC 21 is reduced to three, it is possible to make simple the formation of the driver IC 21, and to reduce the cost thereof.

Sixth Example

Figure 19:
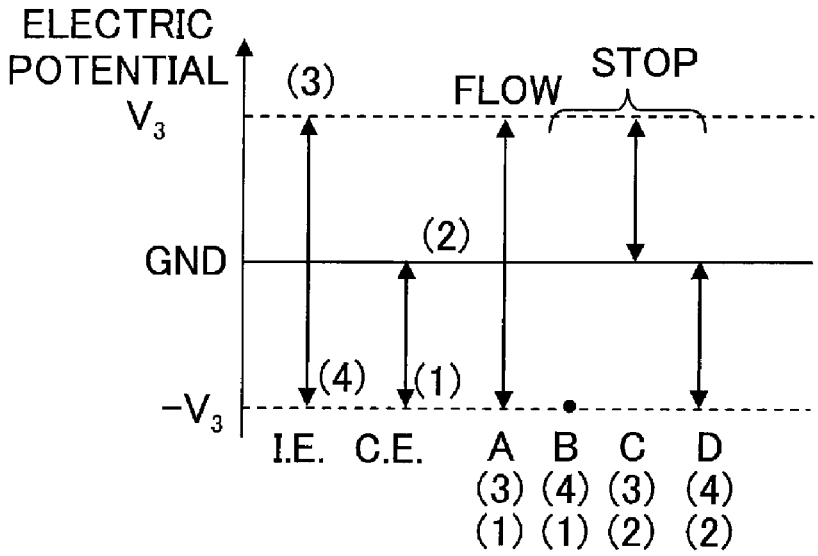
FIG. 19 is a diagram showing a relation of tour electric potentials $V_1$ to $V_4$ in a sixth example of the second modified embodiment.

In the first embodiment, the first electric potential $V_1$ and the fourth electric potential $V_4$ were the same electric potentials, and further, the second electric potential $V_2$ is the intermediate electric potential between the first electric potential $V_1$ and the third electric potential $V_3$, in other words, $V_2=(V_3+V_1)/2$ (refer to FIG. 6). It is possible to satisfy this condition even in a combination other than the combination mentioned above. For example, as shown in FIG. 19, both the first electric potential $V_1$ and the fourth electric potential $V_4$ may be the same electric potential ($=-V_3$), and the second electric potential $V_2$ maybe the ground electric potential which is an intermediate electric potential between the first electric potential $V_1$ and the third electric potential $V_3$. Even in a sixth example, since a difference between the electric potential difference A and the electric potential difference B, C or D can be kept to be greater than or equal to $|V_3-V_1|/2$ ($=V_3$) all the time, it is possible to perform stably the ink transporting operation and the stopping operation, where the potential difference A is a potential difference between the common electrode 17 and the individual electrode 22 in the individual channel 15 which transports the ink to the discharge port 15*a*, and the electric potential difference B, C and D are differences between the common electrode 17 and the individual electrode 22 in the individual channel 15 which does not transport the ink. Furthermore, since the second electric potential $V_2$ is the ground electric potential, the number of types of the electric potentials applied to the common electrode 17 and the individual electrode 22 by the driver IC 21 are restricted to two namely the first electric potential $V_1$ (=fourth electric potential $V_4$) and the third electric potential $V_3$, it is possible to make simple the formation of the driver IC 21, and to improve an effect of the cost reduction.

Seventh Example

Figure 20:
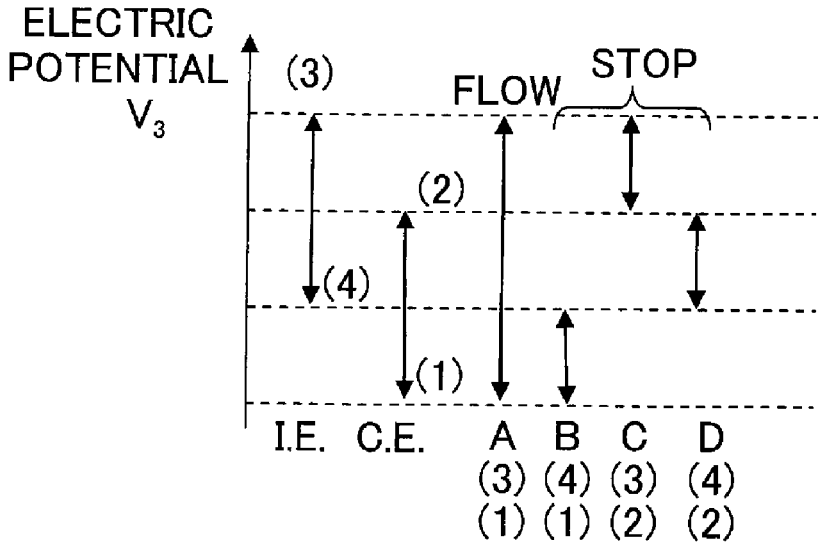
FIG. 20 is a diagram showing a relation of four electric potentials $V_1$ to $V_4$ in a seventh example of the second modified embodiment.

As shown in FIG. 20, the second electric potential may be shown as $V_2=V_1+(V_3-V_1)\times 2/3=(2V_3+V_1)/3$, and furthermore, the fourth electric potential may be shown as $V_4=V_1+(V_3-V_1)/3=(V_3+2V_1)/3$. In a seventh example, since the difference between the electric potential difference A and the potential difference B, C and D can be let to be the potential difference of $|V_3-V_1|\times 2/3$, it is possible to perform stably the ink transporting operation and the stopping operation, where the potential difference A is a potential difference between the common electrode 17 and the individual electrode 22 in the individual channel 15 which transports the ink to the discharge port 15*a*, and the electric potential difference B, C and D are differences between the common electrode 17 and the individual electrode 22 in the individual channel 15 which does not transport the ink.

Eighth Example

Figure 21:
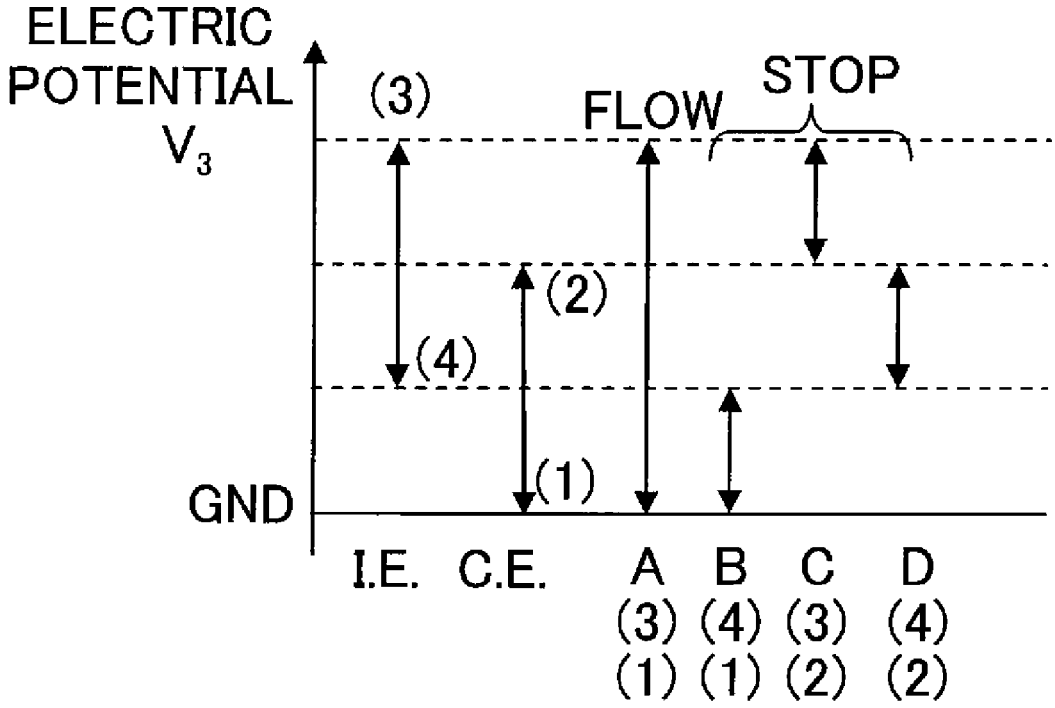
FIG. 21 is a diagram showing a relation of four electric potentials $V_1$ to $V_4$ is an eighth example of the second modified embodiment.

Furthermore, the number of electric potentials applied to the common electrode 17 and the individual electrode 22 by the driver IC may be reduced by letting any one of the four electric potentials $V_1$ to $V_4$ (the first electrode $V_1$ in FIG. 21) to be the ground electric potential, as shown in FIG. 21.

Third Modified Embodiment

Figure 22:
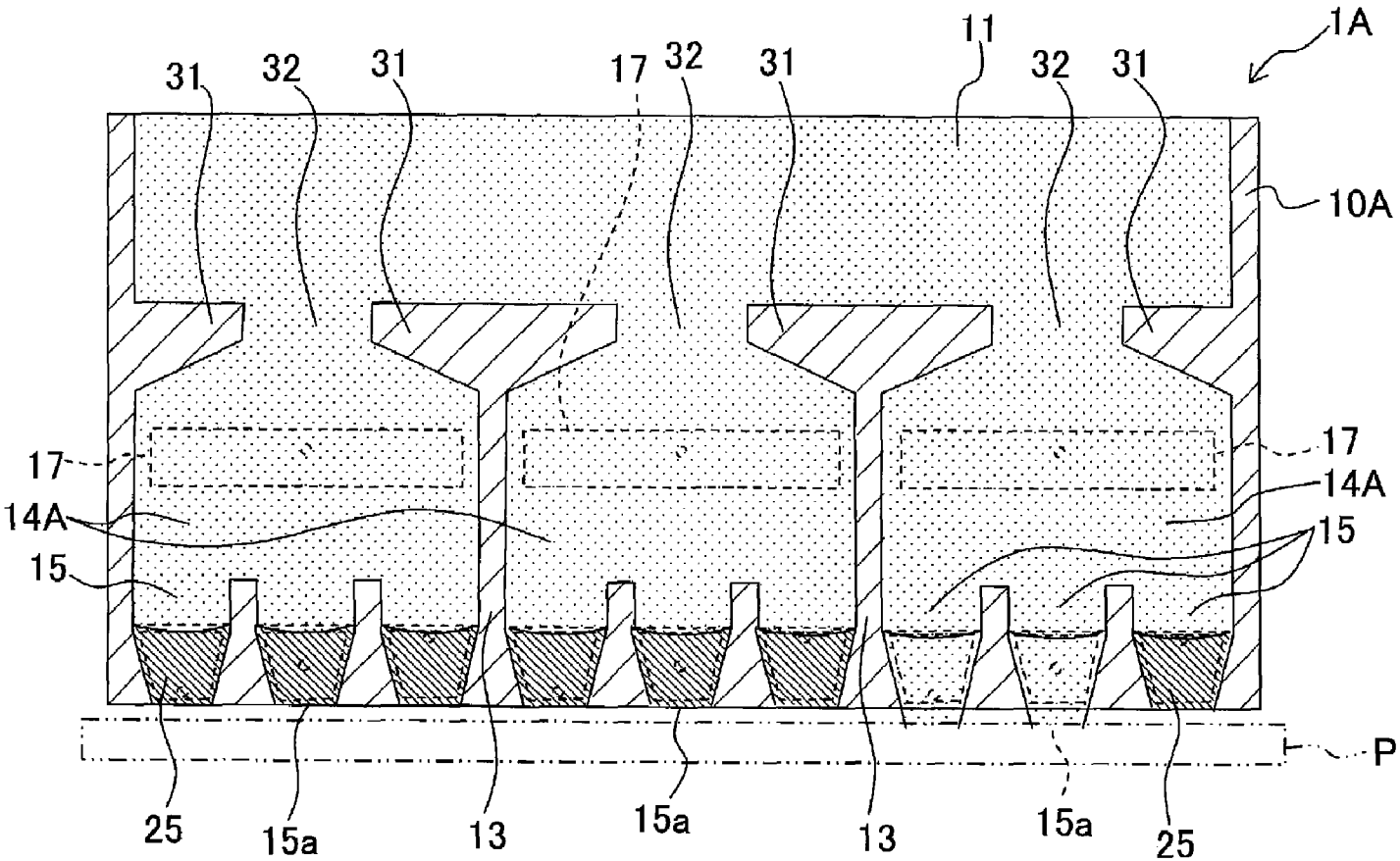
FIG. 22 is a horizontal cross-sectional view of an ink transporting head of a third modified embodiment.

As shown in an ink transporting head 1A in FIG. 22, a throttle 32 having a channel area narrower than a (channel area of) common channel 14A may be provided to a communicating portion of each common channel 14A and the ink inflow section 11, by forming a projection 31 projected toward an inner side of the common channel 14A, on an upstream side of the common electrode 14A, on a partition wall 13A and an inner wall of a head main body 10A forming the common channel 14A. According to this formation, a negative effect of electrolysis etc. of water in the ink caused due to the electric potential difference of the ink between the adjacent common channels 14A is suppressed. Moreover, since a temporary change in the electric potential of the ink in each ink channel, from the electric potential of the common electrode 17, which is caused due to flowing in or flowing out of a large amount of the ink between the common channel 14A and the ink inflow section 11, is suppressed, the electric potential of the ink is stabilized, and it is possible to perform assuredly the ink transporting operation and the stopping operation.

Second Embodiment

Next, a second embodiment of the present invention will be described by referring to FIG. 23 to FIG. 29. In the second embodiment, since the formation of the ink transporting head differs from the formation in the first embodiment, mainly the ink transporting head is described, and the description of formation other than the formation of the ink transporting head, which is almost same as the formation in the first embodiment is omitted.

Figure 23:
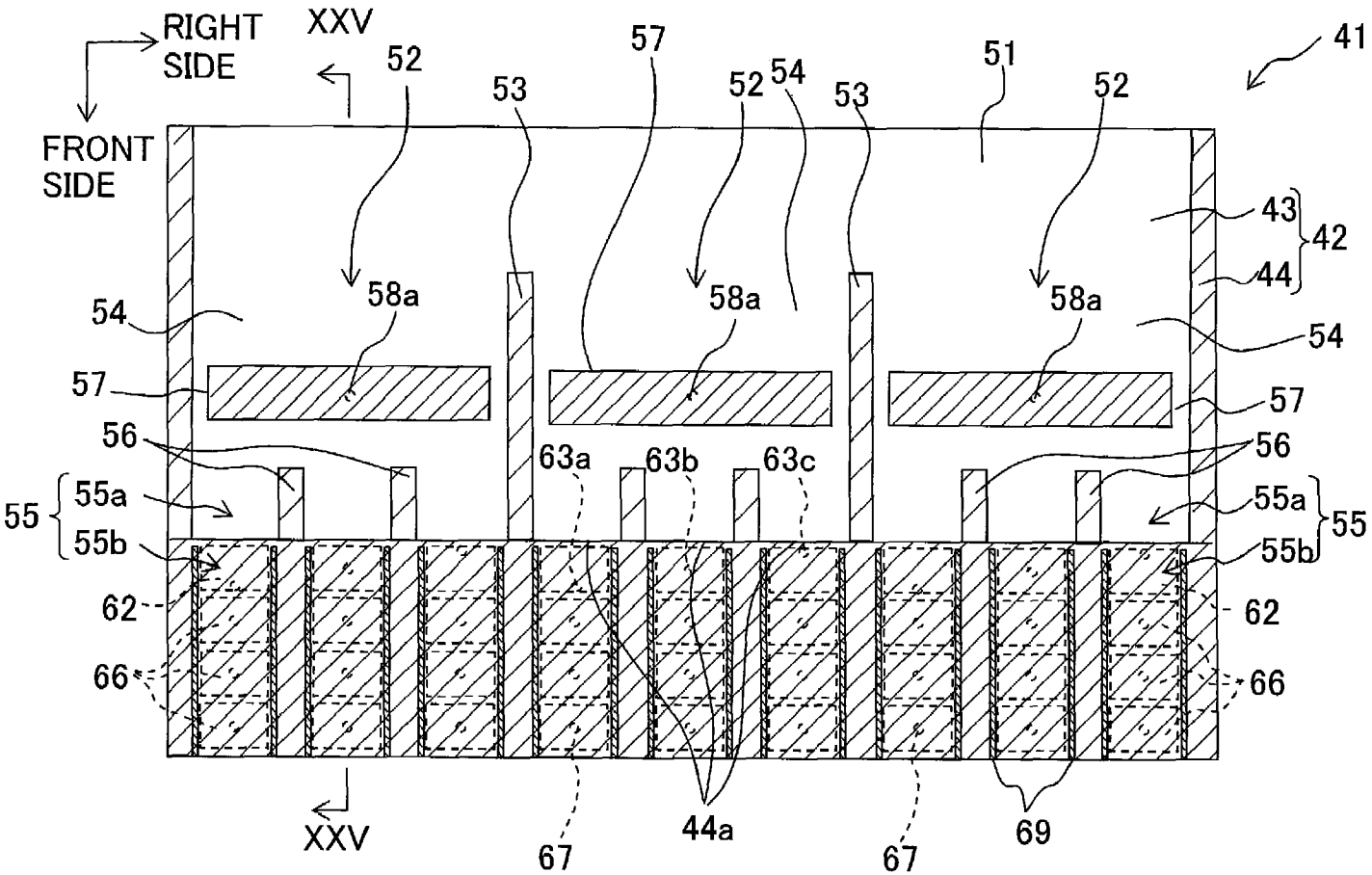
FIG. 23 is a horizontal cross-sectional view of an ink transporting head of a second embodiment.
Figure 24:
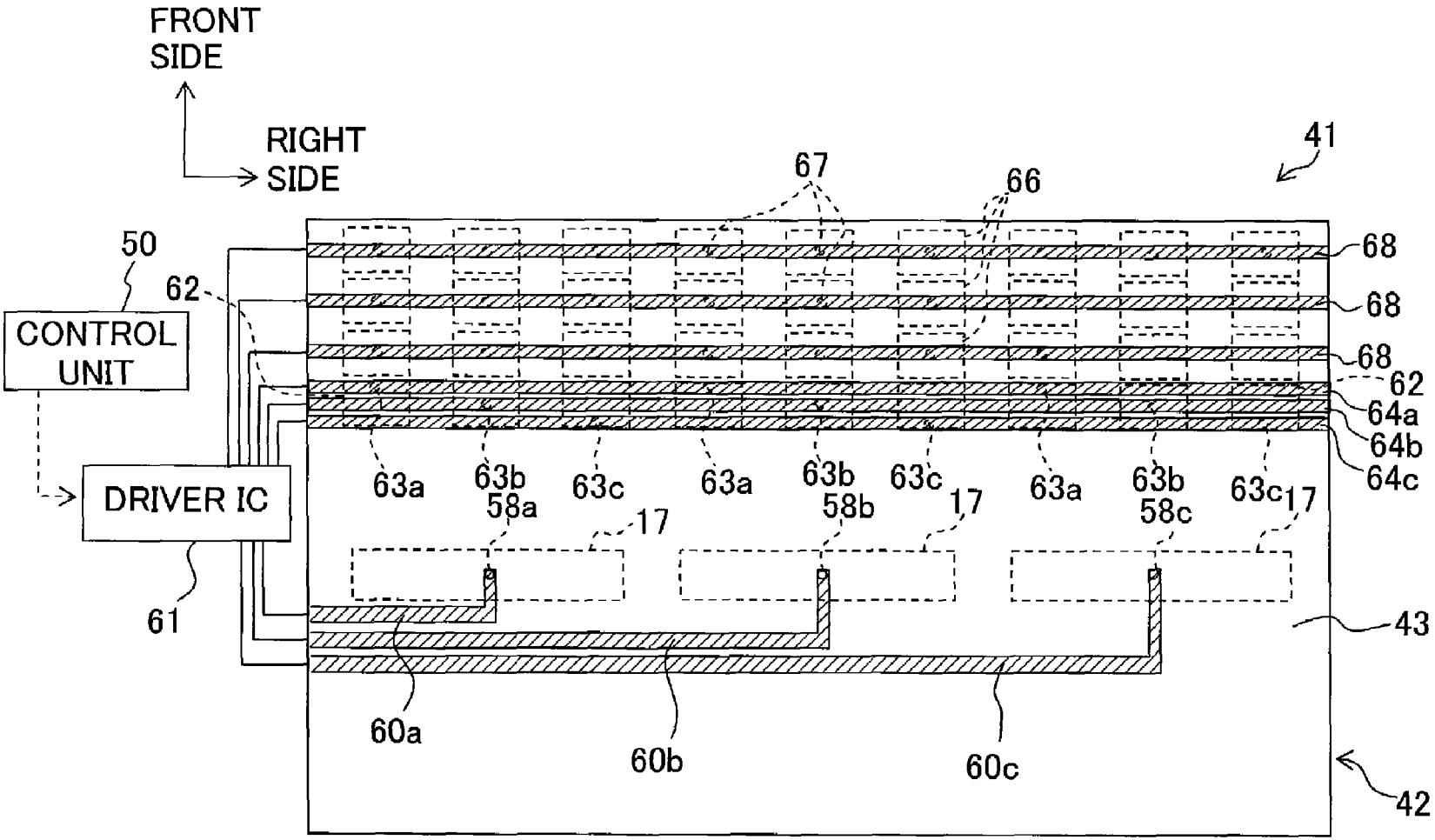
FIG. 24 is a bottom view of the ink transporting head.
Figure 25:
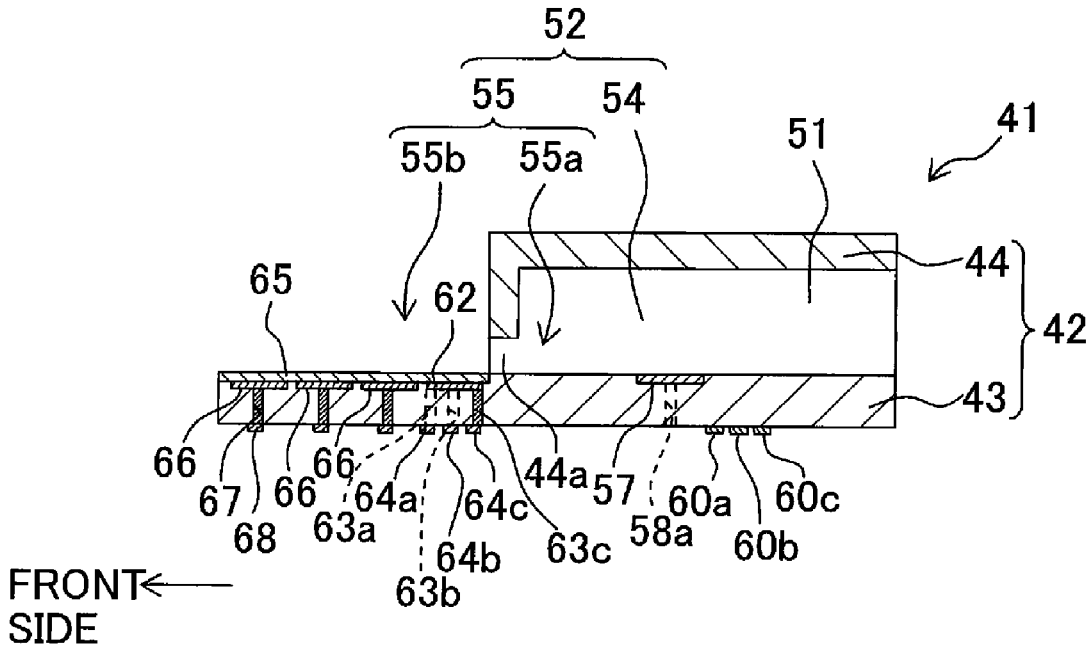
FIG. 25 is a cross-sectional diagram taken along a line XXV-XXV shown in FIG. 23.

As shown in FIG. 23 to FIG. 25, an ink transporting head 41 of the second embodiment has a head main body 42 which forms an outer casing, and further, the head main body 42 includes a substrate 43 having a rectangular shape in a left and right direction (horizontal direction) in FIG. 23, and a box-shaped member 44 provided on an upper surface of a rear side portion of the substrate 43. Moreover, an ink inflow section 51 (liquid inflow section) and three ink channels 52 extended in a forward direction, each (ink channel 52) branched from the ink inflow section 51 are formed by the upper surface of the substrate 43 and the box-shaped member 44. Similarly as in the first embodiment, the head pressure of the ink tank 2 (refer to FIG. 1) is applied all the time to the ink in the box-shaped member 44 for generating a flow in a direction toward the recording paper P in the forward direction, and even in the second embodiment, it is possible to transport the ink even if the head pressure is not applied.

As shown in FIG. 25, the ink inflow section 51 is formed at a rear portion of an inside of the box-shaped member 44. Moreover, as shown in FIG. 23, each ink channel 52 has a common channel 54 which communicates with the ink inflow section 51, and three individual channels 55 which are branched from the common channel 54. The common channel 54 is also formed inside the box-shaped member 44, and the three common channels 54 are separated mutually by partition walls 53 extended forward and backward between the three common channels 54. On the other hand, each individual channel 55 includes a first channel 55a formed in the box-shaped member 44, and communicating with the common channel 54, and a second channel 55*b* formed on an upper surface of a front portion of the substrate 43. The three first channel portions 55 of each ink channel 52 are separated mutually by partition walls 56 extended forward and backward between the three first channel 55*a*. Moreover, the first channel 55*a* and the second channel 55*b* communicate via a leading port 44*a* formed on a front surface the box-shaped member 44.

On a bottom surface (upper surface of the substrate 43: channel forming surface) of each common channel 54, a common electrode 57 which is rectangular shaped in a plan view, and extended over almost entire area in a direction of width of the common channel 54 is formed, and the electroconductive ink in the common channel 54 is in contact all the time with the common electrode 57. Moreover, the common electrodes 57 provided to the three common channels 54 respectively, are connected to a driver IC 61 via an electroconductive material filled in three through holes 58*a*, 58*b*, and 58*c* formed in the substrate 43, and three wirings 60*a*, 60*b*, and 60*c* formed on a lower surface of the substrate 43. Moreover, based on instructions from a control unit 50, any one of two predetermined electric potentials (the first electric potential $V_1$ and the second electric potential $V_2$) is applied selectively to each common electrode 57, from the driver IC 61.

On an upper surface (channel forming surface) of the second channel portion 55*a* of the three individual channels 55 branched from each common channel 54, three leading electrodes 62 (individual electrodes) adjacent to a leading port 44*a* are formed. Moreover, the leading electrodes 62 of each ink channel 52 correspond respectively to leading electrodes 62 provided at the same position in another ink channel 52, and the corresponding three leading electrodes 62 are in mutual conduction via an electroconductive material filled in three through holes 63*a*, 63*b*, and 63*c* formed in the substrate 43, and three wirings 64*a*, 64*b*, and 64*c* formed on the lower surface of the substrate 43. Moreover, the leading electrodes 62 in mutual conduction are connected to the driver IC 61 which is a driving circuit, via the wirings 64*a*, 64*b*, and 64*c*, and based on the instructions from the control unit 50, any one of two predetermined electric potentials (the third electric potential $V_3$ and the fourth electric potential $V_4$) is applied commonly to the leading electrodes 62 in mutual conduction, from the driver IC 61.

Furthermore, on the upper surface of the second channel portion 55*b* of each individual channel 55, three transporting electrodes 66 are provided in a row along the second channel portion 55*b*, from a position adjacent to the leading electrode 62. Moreover, transporting electrodes 66 having the same order of arrangement (arranged in the same order), are lined up in one row in left and right direction (horizontal direction). Furthermore, overlapping with a central portion of each transporting electrode 66, a through hole 67 is formed at a position on the substrate 43, and the transporting electrodes 66 arranged in the same order are mutually conducted via an electroconductive material filled in the through hole 67, and a wiring 68 formed on the lower surface of the substrate 43. Moreover, the transporting electrodes 66 in mutual conduction are connected to the driver IC 61 via the wiring 68, and same as the leading electrodes 62 described above, any one of the two predetermined electric potentials (the third electric potential $V_3$ and the fourth electric potential $V_4$) is applied commonly to the transporting electrodes 66 in mutual conduction, from the driver IC 61.

An insulating layer 65 is provided continuously so as to cover all the leading electrodes 62 and all the transporting electrodes 66 in an area on an external side of the boxed-shaped member 44 on the upper surface of the substrate 43. Here, when there is no electric potential difference between the ink and the leading electrode 62, the wetting angle of the ink on a surface of the insulating layer 65 of the second channel portion 55*b* is greater than the wetting angle of the ink on an inner surface of the first channel portion 55*a*. However, when the electric potential difference is generated between the ink and the leading electrode 62 or the transporting electrode 66, the wetting angle of the ink on the surface of the insulating layer 65 covering these electrodes (the leading electrode 62 and the transporting electrode 66) is decreased due to the electrowetting phenomenon.

Moreover, in the ink transporting head 41 of the second embodiment, similarly as in the first embodiment, from the driver IC 61, when the first electric potential $V_1$ is applied to the common electrode 57 which is in contact with the ink, and the third electric potential $V_3$ is applied to the leading electrode 62 or the transporting electrode 66, since the electric potential difference $V_3-V_1$ becomes greater than or equal to the critical electric potential difference Va (refer to FIG. 5), the wetting angle of the ink on the surface of the insulating layer 65 covering the leading electrode 62 or the transporting electrode 66 becomes smaller than or equal to the critical wetting angle θa. At this time, the ink may exist on the surface of the insulating layer 65 covering the electrode to which the third electric potential $V_3$ is applied. Therefore, the ink can flow to an area in which the electrode, to which the third electric potential $V_3$ is applied, is arranged. On the other hand, for combinations of the electric potentials other than the combination mentioned above, in other words, when the second electric potential $V_2$ is applied to the common electrode 57, or when the fourth electric potential $V_4$is applied to the leading electrode 62 or the transporting electrode 66, the electric potential difference between the ink and the leading electrode 62 or the transporting electrode 66 is less than the critical electric potential difference Va, and the angle of wetting of the ink on the surface of a portion of the insulating layer 65 is greater than the critical wetting angle θa. Therefore, the ink cannot exist in this area.

On the upper surface of the insulating layer 65, an electrode 69 which is extended in a forward and backward direction on both sides of the second channel portion 55*b* is provided. It is not shown particularly in the diagram, but this electrode 69 is also connected to the driver IC 61, and is kept at the ground electric potential all the time, via the driver IC 61.

An ink transporting operation by the ink transporting head 41 of the second embodiment will be described below by referring to FIG. 26 to FIG. 29. The combinations of the four electric potentials $V_1$ to $V_4$ in the second embodiment are same as the combinations showed in FIG. 6 of the first embodiment. Moreover, the third electric potential $V_3$ is 30 V, the second electric potential $V_2$ (=$V_3$/2) is 15 V, and the critical electric potential difference Va is 25 V. Consequently, the electric potential difference $V_3-V_1$ (=30 V) between the third electric potential $V_3$ and the first electric potential $V_1$ is greater than the critical electric potential difference Va. However, the electric potential difference in the other combinations of the electric potentials (for example the electric potential difference $V_3-V_2$ (=15 V) between the third electric potential $V_3$ and the second electric potential $V_2$) is less than the critical electric potential difference Va.

All the leading electrodes 62 are also kept at the ground electric potential (fourth electric potential), when all the common electrodes 57 are kept at the ground electric potential (first electric potential). The potential difference between the ink in contact with the common electrode 57, and the leading electrode 62 becomes zero, which is less than the critical electric potential difference Va. At this time, the ink I in the first channel portion 55*a* does not flow out from the leading port 44*a* to the second channel portion 55*b*, because the wetting angle of the ink on the insulating layer 65 covering the surface of the leading electrode 62 is greater than the critical wetting angle θa.

Figure 26:
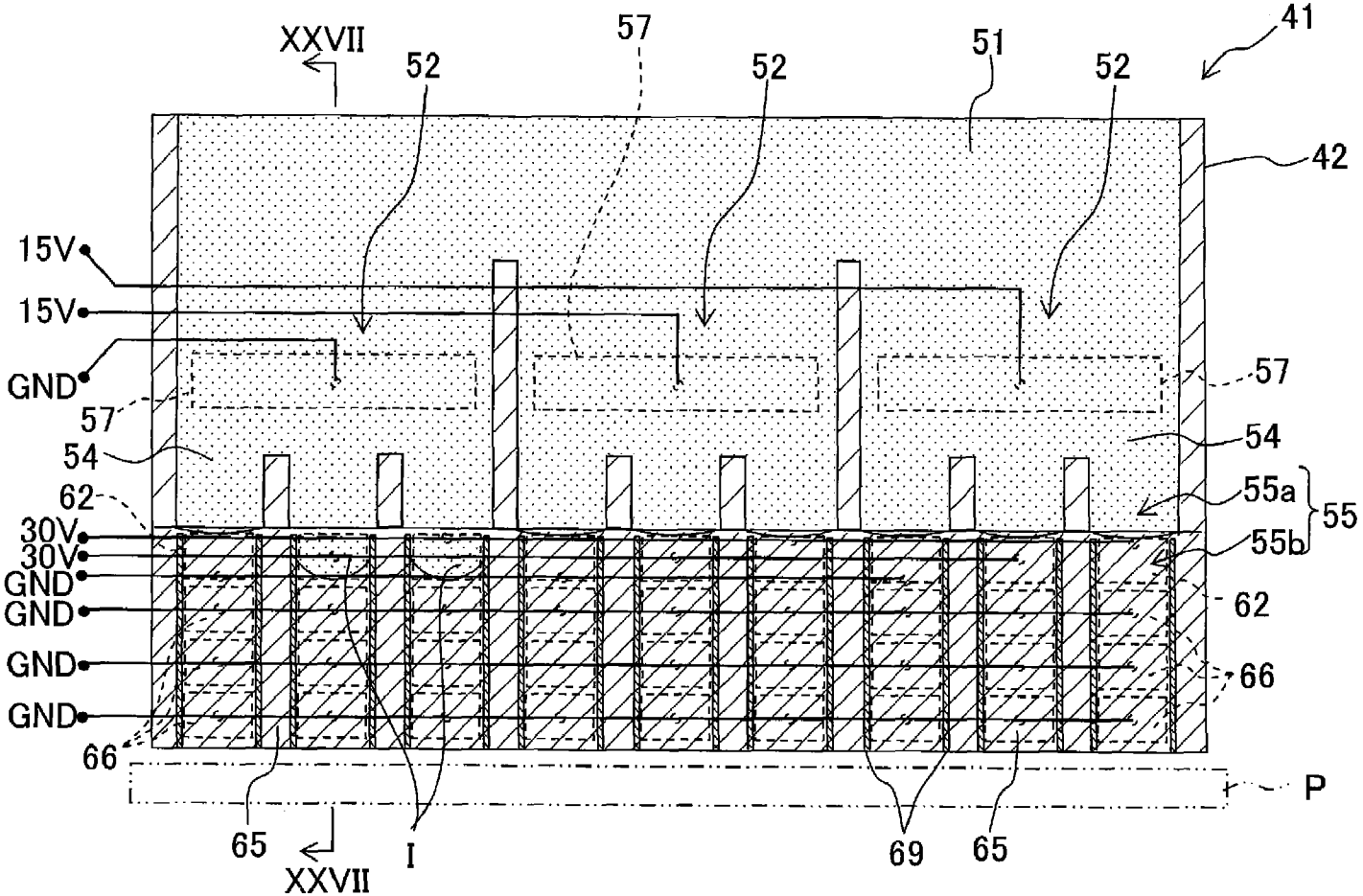
FIG. 26 is a horizontal cross-sectional view of the ink transporting head in a state of leading the ink from a part of leading ports.
Figure 27:
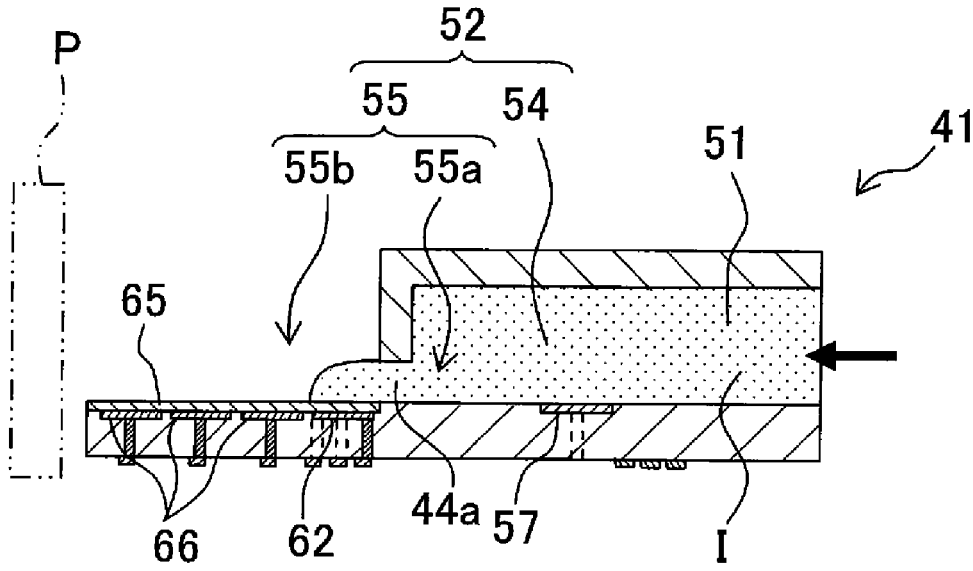
FIG. 27 is a cross-sectional view taken along a line XXVII-XXVII shown in FIG. 26.

As shown in FIG. 26 and FIG. 27, the electric potential (second electric potential) of 15 V is applied from the driver IC 61 to each of the two common electrodes 57 formed on the two common channels 54, one at the right end and the other at the center. The electric potential (third electric potential) of 30 V is applied from the driver IC 61 to the two leading electrodes 62 formed on the two individual channels 55 of each ink channel 52, one positioned at the right end and the other positioned at the center. Here, as it has been mentioned earlier, the electric potential of 30 V is applied simultaneously to the leading electrodes 62 of the individual channels 55 (second channel portion 55*b*) positioned at the right end and the center, since corresponding leading electrodes 62 with respect to the three ink channels 52 are in mutual conduction via the wirings 60*a*, 60*b*, and 60*c*, for all the ink channels 52.

At this time, in the two individual channels 55 (second channel portion 55*b*) positioned at the center and the right end of the three individual channels 55 of the ink channel 52 at the left end, the electric potential difference between the ink in contact with the common electrode 57 and the leading electrode 62 becomes 30 V, which is greater than the critical electric potential difference Va. Therefore, the wetting angle θ of the ink on the surface of the insulating layer 65 covering the leading electrode 62 is decreased, and becomes smaller than the critical wetting angle θa. Moreover, the head pressure of the ink tank 2 is applied all the time to the ink in the first channel portion 55*a* in the box-shaped member 44 so as to generate the flow in a direction toward the forward direction . Therefore, the ink I in the first channel portion 55*a* flows out to a position of the leading electrode 62 of the second channel portion 55*b*, via the leading port 44*a*. On the other hand, in the two individual channels 55 positioned at the center and the right end in the ink channels 52 at the right end and the center, the electric potential difference between the ink in contact with the common electrode 57, and the leading electrode 62 becomes 15 V. However, the ink I in the first channel portion 55*a* does not flow out from the leading port 44*a* to the second channel portion 55*b*, because this electric potential difference is less than the critical electric potential difference Va. Consequently, only in the two individual channels 55 of the ink channel 52 at the left end where the common electrode 57 is at the ground electric potential and the leading electrode 62 is at the electric potential of 30 V, the ink is lead out through the leading port 44*a*. In other words, similarly as in the first embodiment, the matrix drive is available even in the ink transporting head of the second embodiment.

Figure 28:
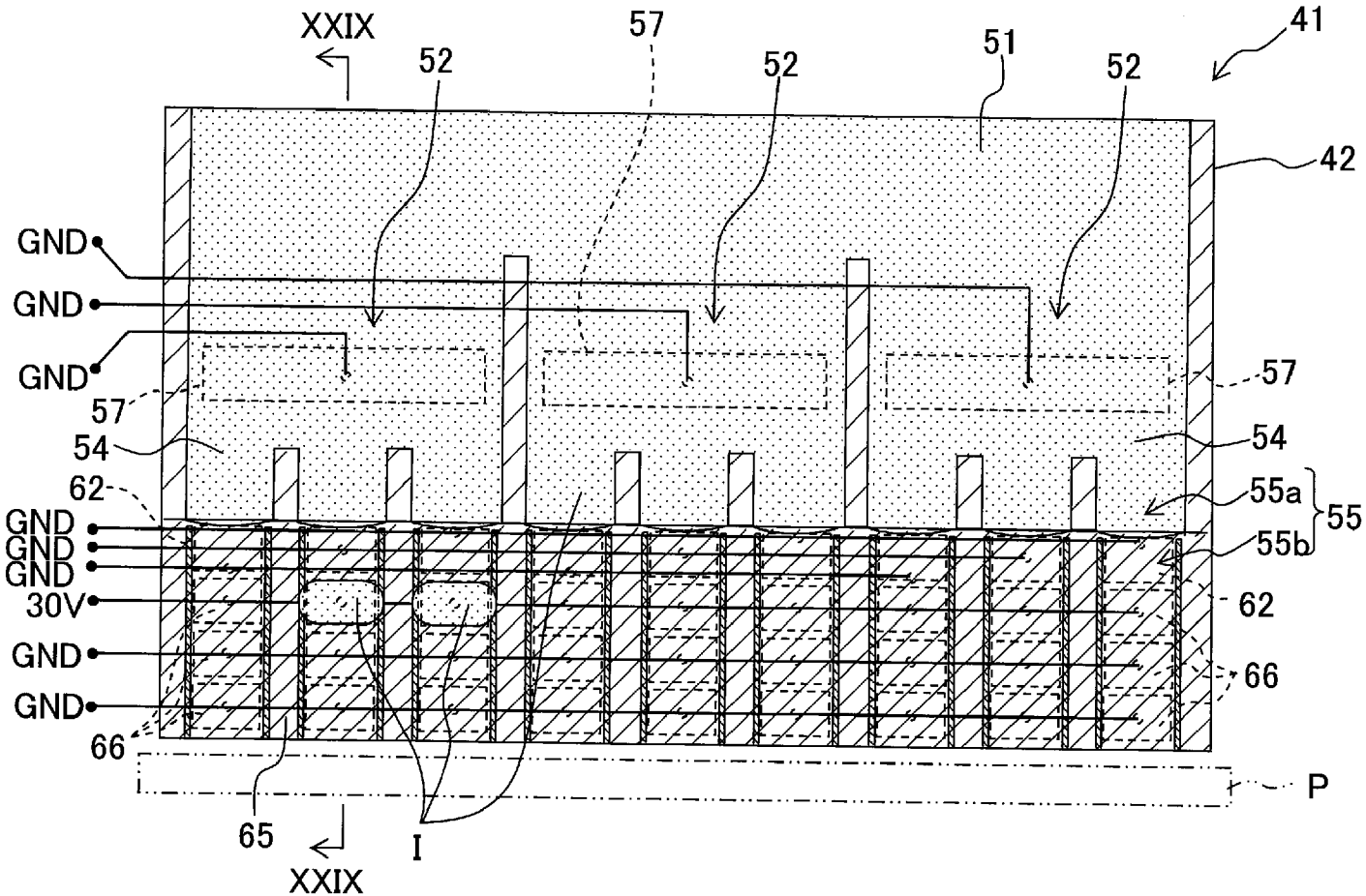
FIG. 28 is a horizontal cross-sectional view of the ink transporting head in a state of transporting the ink.
Figure 29:
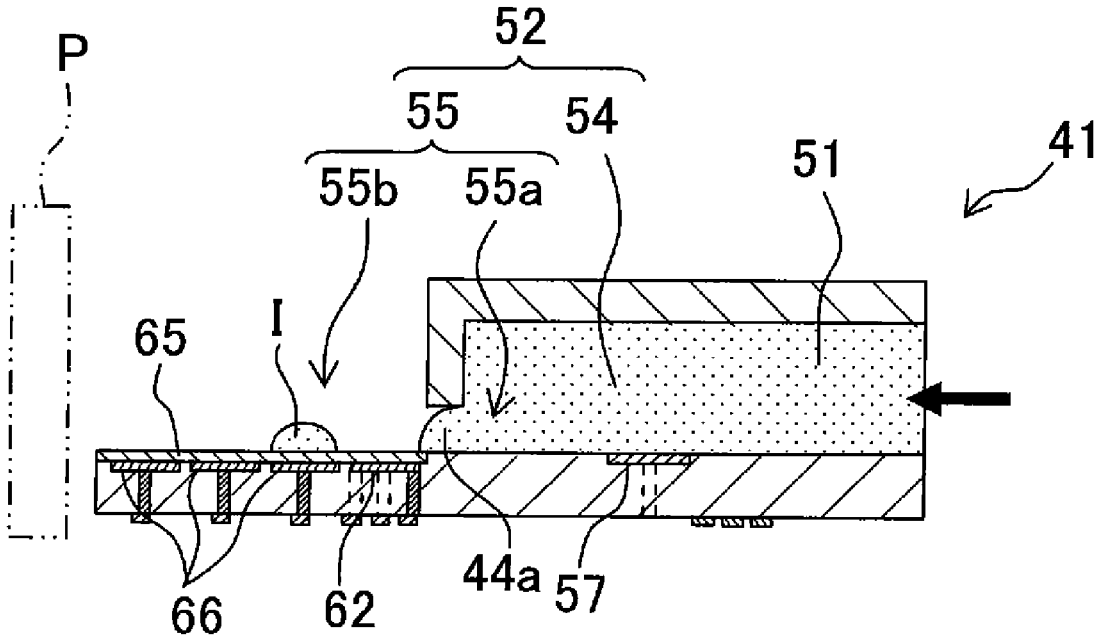
FIG. 29 is a cross-sectional view taken along a line XXIX-XXIX shown in FIG. 28.

Next, as shown in FIG. 28 and FIG. 29, the electric potential difference between the ink and the leading electrode 62 becomes zero, when the ground electric potential (fourth electric potential) is applied to all the leading electrodes 62be, and the electric potential (third electric potential) of 30 V is applied commonly to the transporting electrode 66 adjacent to the leading electrode 62, whereas the electric potential difference between the ink and the transporting electrode 66 becomes 30 V which is greater than the critical electric potential difference Va. Consequently, the ink I moves from a position of the leading electrode 62 to a position of the transporting electrode 66 in the individual channel 55 to which the ink is lead through the leading port 44*a*, since the wetting angle of the ink on the surface of the insulating layer 65 covering the leading electrode 62 becomes greater than the critical wetting angle θa, and the wetting angle of the ink on the surface of the insulating layer 65 covering the transporting electrode 66 becomes smaller than the critical wetting angle θa. Moreover, it is possible to transport liquid droplets of ink to the recording paper P at the front side due to applying the electric potential of 30 V to the three transporting electrodes 66 lined up in forward and backward direction, in an order from rear to front. Here, since an electrode kept at the ground electric potential all the time is provided on both sides of the second channel portion 55*b*, the ink lead through the leading port 44*a* to the second channel portion 55*b* is kept at the ground electric potential all the time. Therefore, the electric potential of the ink is not fluctuated (not changed), and it is possible to transport stably the ink in the forward direction.

Third Embodiment

Next, a third embodiment of the present invention will be described by referring to FIG. 30 to FIG. 35. Even in the third embodiment, since the formation of the ink transporting head differs from the formation in the first embodiment, mainly the ink transporting head is described, and the description of formation other than the formation of the ink transporting head, which is almost same as the formation in the first embodiment is omitted.

Figure 30:
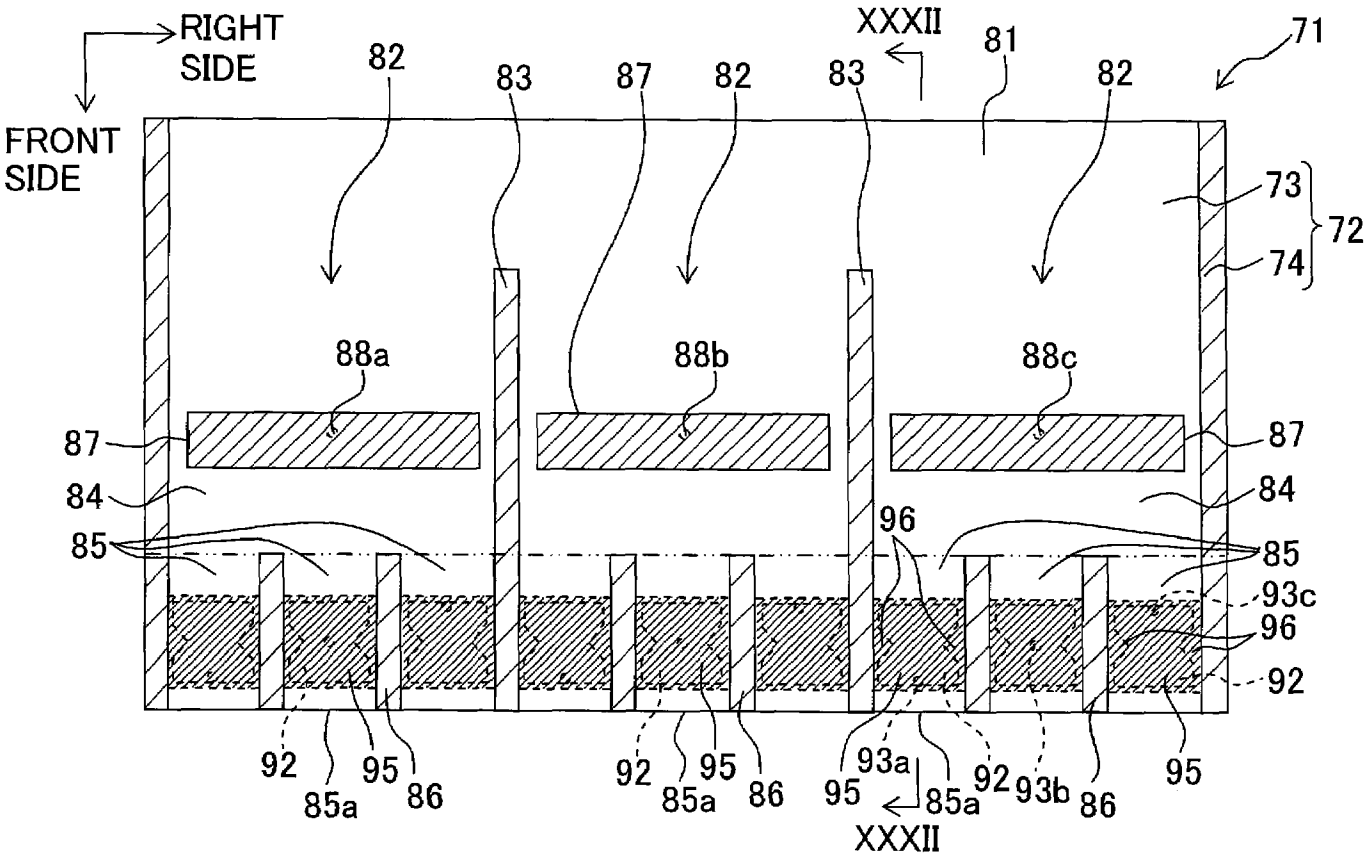
FIG. 30 is a horizontal cross-sectional view of an ink transporting head of a third embodiment.
Figure 31:
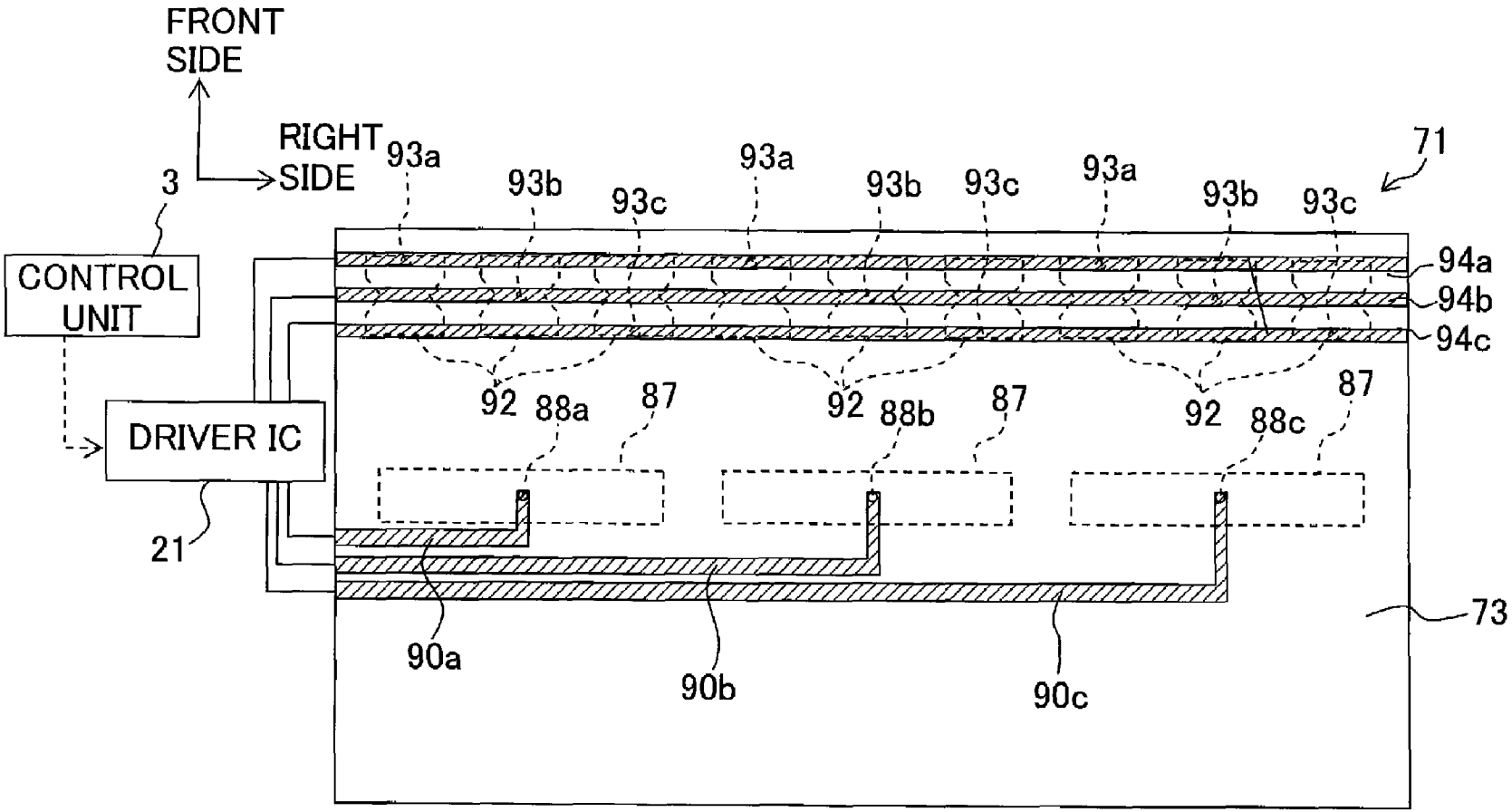
FIG. 31 is bottom view of the ink transporting head.
Figure 32:
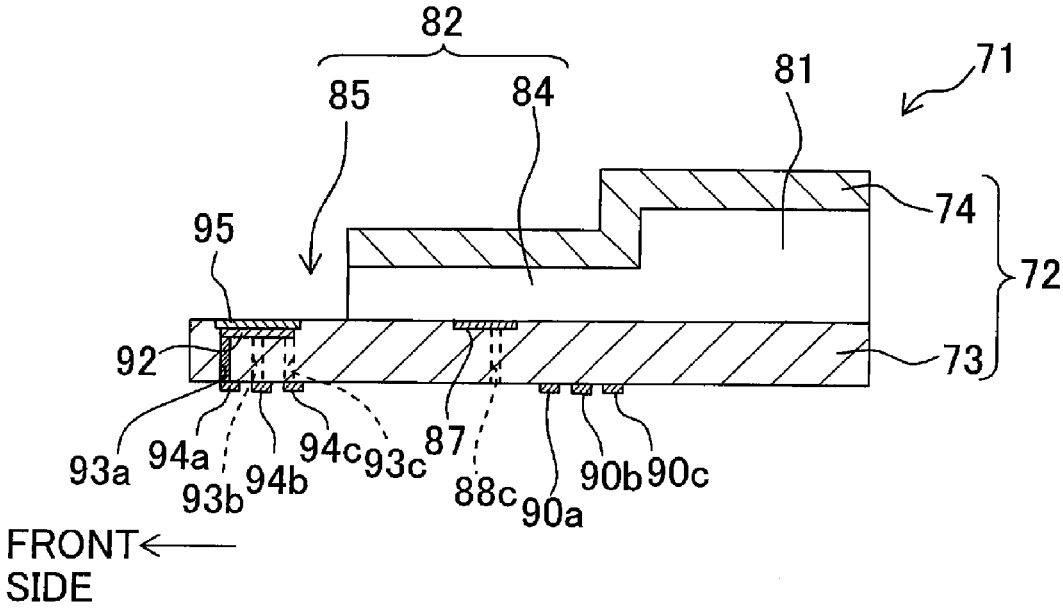
FIG. 32 is a cross-sectional view taken along a line XXXII-XXXII shown in FIG. 30.

As shown in FIG. 30 to FIG. 32, an ink transporting head 71 of the third embodiment has a head main body 72 which forms an outer casing, and further, the head main body 72 includes a substrate 73 having a rectangular shape in a left and right direction (horizontal direction) in a plan view, and a box-shaped member 74 provided on an upper surface of a rear side portion of the substrate 73. Moreover, an ink inflow section 81 (liquid inflow section) and three ink channels 82 extended in a forward direction each (ink channel 82) branched from the ink inflow section 81 are formed by the upper surface of the substrate 73 and the box-shaped member 74.

As shown in FIG. 32, the ink inflow section 81 is formed at a rear portion of an inside of the box-shaped member 74. Moreover, as shown in FIG. 30, the ink inflow section 81 is formed at a rear portion of an inside of the box-shaped member 74. Furthermore, as shown in FIG. 30, each ink channel 82 has a common channel 84 which communicates with the ink in flow section 81, and three individual channels 85 which are branched from the common channel 84. The common channel 84 is also formed inside the box-shaped member 74, and three common channels 84 are separated mutually by partition walls 83 extended forward and backward, between the three common channels 84. On the other hand, each individual channel 85 is formed on a surface of a front portion of the substrate 73 and the surface being arranged an outer side of the box-shaped member 74. Moreover, the three individual channels 85 of each ink channel 82 are separated mutually by partition walls 86 extended forward and backward between the three individual channels 85. Consequently, as shown in FIG. 32, each individual channel 85 is formed to be opened upward. Moreover, a discharge port 85*a* which opens toward a front side is provided at a front end of each individual channel 85. In the third embodiment, unlike in the first and the second embodiment, the pressure to generate the flow of the ink toward the discharge port 85*a* is not applied to the ink in the ink channel 82 (the pressure applying unit is not provided).

On a bottom surface (upper surface of the substrate 73: channel forming surface) of each common channel 84, a common electrode 87 which is rectangular shaped in a plan view, and extended over almost entire area in a direction of width of the common channel 84 is formed, and the electroconductive ink in the common channel 84 is in contact all the time with the common electrode 87. Moreover, the common electrodes 87 provided to the three common channels 84 respectively, are connected to a driver IC 91 via an electroconductive material filled in three through holes 88*a*, 88*b*, and 88*c* formed in the substrate 73, and three wirings 90*a*, 90*b*, and 90*c* formed on a lower surface of the substrate 73. Moreover, based on instructions from a control unit 80, any one of two predetermined electric potentials (the first electric potential $V_1$ and the second electric potential $V_2$) is selectively applied to each desired common electrode 87, from the driver IC 91.

On an upper surface (channel forming surface) of the three individual channels 85 branched from each common channel 84, individual electrodes 92 are formed respectively. As shown in FIG. 30, a substantially central portion in a forward and backward direction of each individual electrode 92 is narrowed acutely from both sides in a direction of width and have become narrow partially, and each individual electrode 92 is arranged on somewhat upstream side from the discharge port 85*a* of the individual channel 85. Moreover, the individual electrodes 92 of each ink channel 82 correspond respectively to individual electrodes 92 provided at the same position in another ink channel 82, and the corresponding individual electrodes 92 are in mutual conduction via an electroconductive material filled in three through holes 93*a*, 93*b*, and 93*c* formed in the substrate 73, and three wirings 94*a*, 94*b*, and 94*c* formed on the lower surface of the substrate 73. Moreover, the individual electrodes 92 in mutual conduction are connected to the driver IC 91 which is a driving circuit, via the wirings 94*a*, 94*b*, and 94*c*. Any one of the two predetermined electric potentials (the third electric potential $V_3$ and the fourth electric potential $V_4$) is applied commonly to the individual electrodes 92 in mutual conduction from the driver IC 91 based on the instructions from the control unit 80.

Moreover, on the surface of each individual electrode 92, an insulating layer 95 which covers completely the individual electrodes 92 is formed. Here, when there is not electric potential difference between the ink and the individual electrode 92, the wetting angle of the ink on the surface of the insulating layer 95 becomes greater than the wetting angle of the ink on an inner surface of the individual channel 85 in an area in which the insulating layer 95 is not formed, and the ink may not exist on the surface of the insulating layer 95. However, when the electric potential difference not less than the predetermined critical electric potential difference Va is generated between the ink and the individual electrode 92, the wetting angle of the ink on the insulating layer 95 is decreased to be not greater than the critical wetting angle θa due to the electrowetting phenomenon. The critical wetting angle θa is equivalent (equal) to the wetting angle of the ink on the area on the inner surface of the individual channel 85, in which the insulating layer 95 is not formed.

Furthermore, the insulating layer 95 is formed throughout the entire area in a direction of width of the individual channel 85. However, since the substantially central portion in the forward and backward direction of the individual electrode 92 is constricted, the insulating layer 95 is formed directly on the bottom surface of the individual channel 85, without going through (not via) the individual electrode 92 in two areas 96 which are positioned at both ends in the direction of width of the individual channel 85, and in these two areas 96, the wetting angle of the ink is always greater than the wetting angle of the ink on the inner surface of the individual channel 85 in the area in which the insulating layer 95 is not formed. Therefore, irrespective of the electric potential difference between the ink and the individual electrode 92, these two areas 96 are not wetted by the ink, and air always exists on these areas 96 (refer to FIG. 34).

When the electric potential difference between the ink and the individual electrode 92 is not less than the critical electric potential difference Va, the wetting angle of the ink on the surface of the insulating layer 95 covering the individual electrode 92 becomes smaller than or equal to the critical wetting angle θa. At this time, the ink may exist on the surface of the insulating layer 95 in the area covering the individual electrode 92. However, since the a flow (force) toward the discharge port 85*a* is not applied to the ink in the individual channel 85, a meniscus is formed near the discharge port 85a due to a surface tension of the ink, and the ink is discharged from the discharge port 85*a*. In this state, when the wetting angle of the ink on the surface of the insulating layer 95 in the area covering the individual electrode 92 is increased to be greater than the critical wetting angle θa by letting the electric potential difference between the ink and the individual electrode 92 to be less than the critical electric potential difference Va, the air is spread to the entire surface of the insulating layer 95 from the two area 96 having the greater wetting angle, and the ink existed on the surface of the insulating layer 95 flows to an up stream side and a down stream side of the individual channel 85. Due to a pressure of the ink flowed to the down stream side, the meniscus formed near the discharge port 85*a* is destroyed, and the ink is discharged from the discharge port 85*a*. In other words, in the ink transporting head 71 of the third embodiment, unlike in the first embodiment and the second embodiment, when the electric potential difference between the ink and the individual electrode 92 is not less than the critical electric potential difference Va, the ink does not flow (is not discharged) in the individual channel 85, but when the electric potential difference between the ink and the individual electrode 92 becomes less than the critical electric potential difference Va, the ink flows to the discharge port 85*a* and is discharged through the discharge port 85*a*.

Furthermore, in the third embodiment, the four electric potentials $V_1$ to $V_4$ applied to the common electrode 87 or the individual electrode 92 from the driver IC 91 are set by the control unit 80 such that at least the following relations are established. Firstly, when the first electric potential $V_1$ is applied to the common electrode 87, and the third electric potential $V_3$ is applied to the individual electrode 92, a relation $|V_3-V_1|<Va$ is established so that the electric potential difference between the ink in contact with the common electrode 87 and the individual electrode 92 becomes less than the critical electric potential difference Va and the ink flows is discharged. On the other hand, when the combination of the electric potentials of the common electrode 87 and the individual electrode 92 is other than the abovementioned combination, each of relations $|V_4-V_1|\geqq Va$, $|V_3-V_2|>Va$, and $|V_4-V_2|\geqq Va$ is established so that the electric potential difference between the ink and the individual electrode 92 becomes not less than the critical electric potential difference Va.

Figure 33:
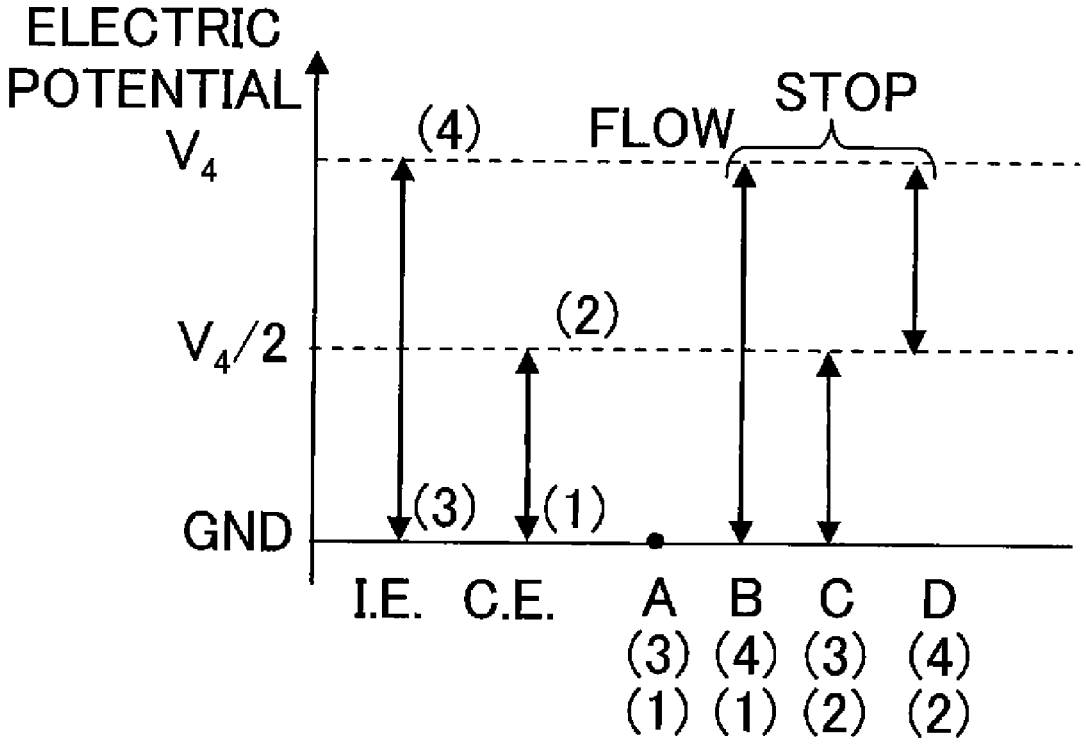
FIG. 33 is a diagram showing an example of a relation of four electric potentials $V_1$ to $V_4$ applied to the common electrode or the individual electrode of the third embodiment.

Furthermore, an example of a preferable combination of the four electric potentials $V_1$ to $V_4$ is shown in FIG. 33. In FIG. 33, the electric potential difference A is the electric potential difference $|V_3-V_1|$ between the third electric potential $V_3$ and the first electric potential $V_1$. In this combination, the ink flows in the individual channel 85. On the other hand, the electric potential difference B is the electric potential difference $|V_4-V_1|$ between the fourth electric potential $V_4$ and the first electric potential $V_1$, the electric potential difference C is the electric potential difference $|V_3-V_2|$ between the third electric potential $V_3$ and the second electric potential $V_2$, and the electric potential difference D is the electric potential difference $|V_4-V_2|$ between the fourth electric potential $V_4$ and the second electric potential $V_2$ and with these combinations of electric potentials, the ink does not flow in the individual channel 85 (stopped state).

As shown in FIG. 33, both the first electric potential $V_1$ and the third electric potential $V_3$ are the ground electric potential (GND), and further, the second electric potential $V_2$ is an intermediate electric potential between the first electric potential $V_1$ and the fourth electric potential $V_4$. In other words, $V_2=(V_4+V_1)/2=V_4/2$. Therefore, it is possible to let the difference between the electric potential difference A and the electric potential difference B, C or D to be greater than or equal to $V_4/2$ all the time, and to perform stably the ink transporting operation and the stopping operation, where the potential difference A is a potential difference between the common electrode 87 and the individual electrode 92 in the individual channel 85 which transports the ink to the discharge port 85*a*, and the electric potential difference B, C and D is potential differences between the common electrode 87 and the individual electrode 92 in the individual channel 85 which does not transport the ink. Moreover, since both the first electric potential $V_1$ and the third electric potential $V_3$ are the ground electric potential, the types of the electric potentials applied to the common electrode 87 and the individual electrode 92 by the driver IC 91 are reduced to two types namely the second electric potential $V_2$ and the fourth electric potential $V_4$. Therefore, it is possible to make simple the formation of the driver IC 91, and to reduce the cost of the electric system including the driver IC 91.

Next, the ink transporting operation (discharge operation) by the ink transporting head 71 will be described below by referring to FIG. 34 to FIG. 37. In the following description, in the combinations of the electric potentials, the fourth electric potential $V_4$ is 30 V, the second electric potential $V_2$ ($=V_4/2$) is 15 V, and the critical electric potential difference Va is 10 V. Consequently, the electric potential difference $V_3-V_1$ (=0 V) between the third electric potential $V_3$ and the first electric potential $V_1$ is less than the critical electric potential difference Va, but the electric potential difference in the other combinations of the electric potentials ($V_4-V_1$ (=30 V), $V_4-V_1$ (=15 V), $V_4-V_1$ (−15 V)) is greater than the critical electric potential difference Va.

Figure 34:
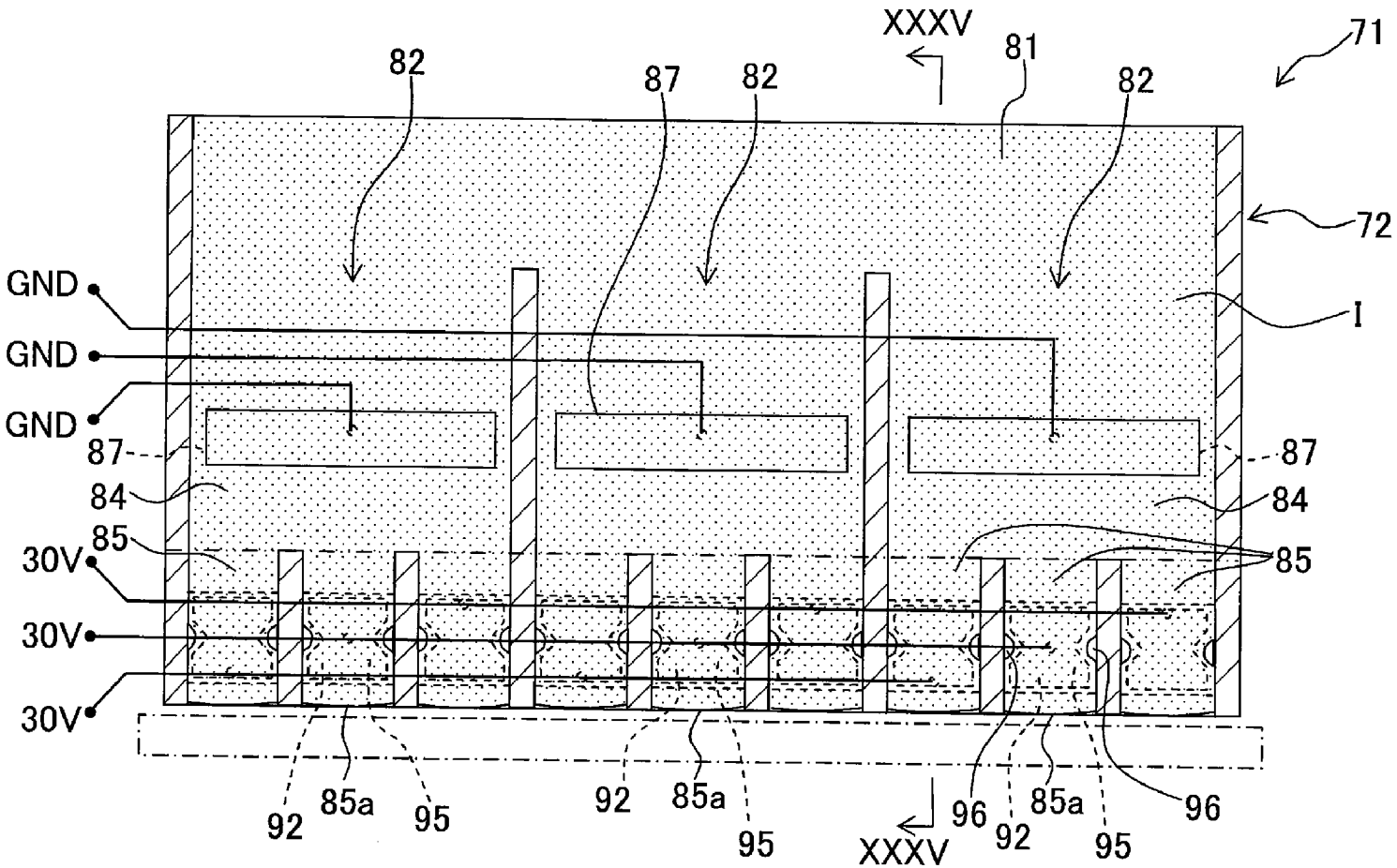
FIG. 34 is a horizontal cross-sectional view of the ink transporting head in the state of not discharging the ink.
Figure 35:
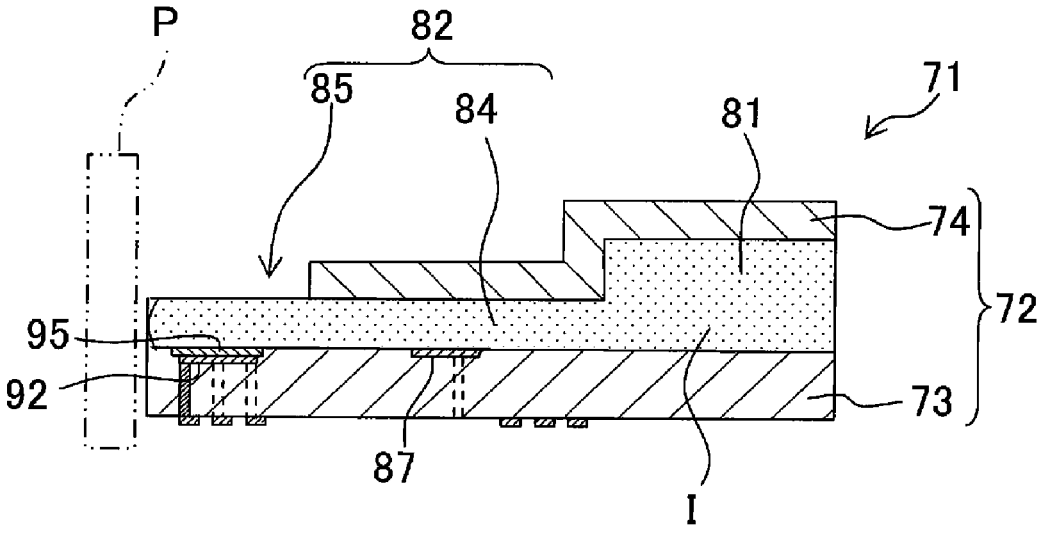
FIG. 35 is a cross-sectional view taken along a line XXXV-XXXV shown in FIG. 34.

As shown in FIG. 34 and FIG. 35, when all the common electrodes 97 are kept at the ground electric potential (first electric potential) and the electric potential of 30 V (fourth electric potential) is applied to all the individual electrodes 92, the electric potential difference between the individual electrode 92 and the ink I in all the individual channels 85 is 30 V. Since the electric potential difference is greater than the critical electric potential difference Va, the wetting angle θ of the ink on the surface of the insulating layer 95 has become smaller than the critical wetting angle θa. The ink exists throughout the entire individual channel 85 including the position at which the individual electrode 92 is formed, and the flow force toward the discharge port 85*a* is not applied to the ink in the individual channel 85. Therefore, a meniscus is formed near the discharge port 85*a*, and the ink I is not discharged from the discharge port 85*a*. In the two areas 96 on the upper surface of the substrate 73 in which the individual electrode 92 is formed on the outer side of the constricted portion, the air exists on the two areas 96, because the wetting angle of the ink is always bigger than (the wetting angle of the ink) the inner surface of the individual channel 85.

Figure 36:
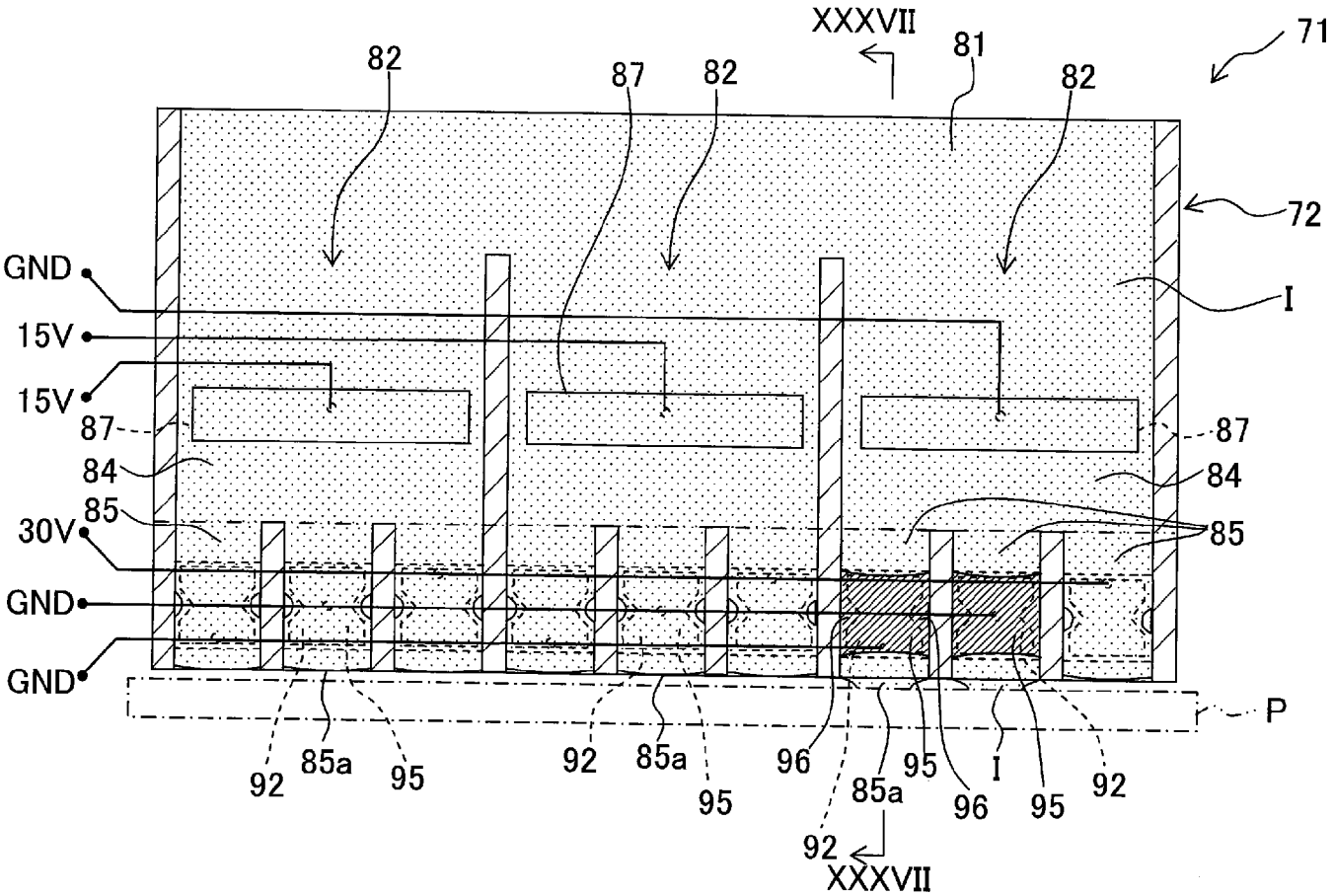
FIG. 36 is a horizontal cross sectional view of the ink transporting head in the state of discharging the ink.
Figure 37:
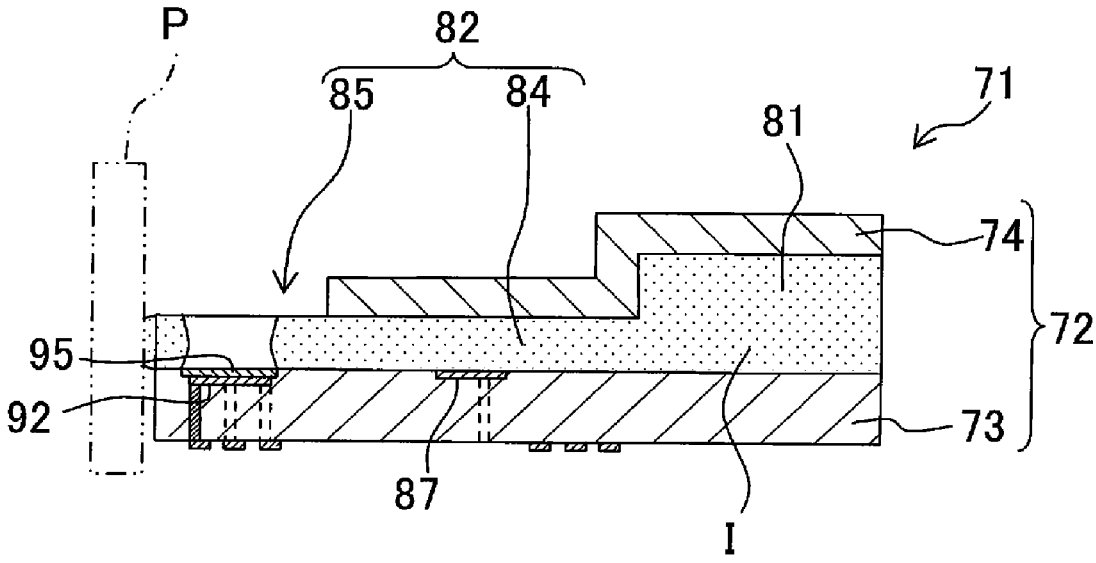
FIG. 37 is a cross-sectional view taken along a line XXXVII-XXXVII shown in FIG. 36.

From this state, as shown in FIG. 36 and FIG. 37, the electric potential (second electric potential) of 15 V is applied from the driver IC 91 to the two common electrodes 87 provided to an ink channel 82 at a left end, and an ink channel 82 at a center respectively, and further, the electric potential of the two individual electrodes 92 formed on the two individual channels 85 positioned at the left end and the center respectively, is let to be switched to the ground electric potential (third electric potential). Here, for the three ink channels 82, since the corresponding individual electrodes 92 are in mutual conduction via the wirings 94*a*, 94*b*, and 94*c*, for all the ink channels 82, the electric potential of the individual electrode 92 of the individual ink channel 85 positioned at the right end and the center is switched simultaneously to the ground electric potential.

At this time, in the two individual channels 85 positioned at the left end and the center in the ink channel 82 at a right end, the wetting angle θ of the ink on the surface of the insulating layer 95 becomes greater than the critical wetting angle θa, because the electric potential difference between the ink I in contact with the common electrode 87, and the individual electrode 92 becomes 0 V which is less than the critical electric potential difference Va. Consequently, air is spread to the entire surface of the insulating layer 95 from the two areas 96 positioned at both ends in the direction of width of the individual channel 85, and the ink existed on the surface of the insulating layer 95 flows to an upstream side and a downstream side of the individual channel 85. At this time, the meniscus formed near the discharge port 85*a* is destroyed by a pressure of the ink I flowed to a downstream side of the insulating layer 95, and the ink I is discharged through the discharge port 85*a*.

On the other hand, in two individual channels 85 positioned at the left end and the center in the ink channel 82 at a left side, the electric potential difference between the ink I in contact with the common electrode 87, and the individual electrode 92 is decreased, and becomes 15 V. Since this electric potential difference is greater than the critical electric potential difference Va, the wetting angle θ of the ink on the surface of the insulating film 95 is smaller than the critical wetting angle θa. Therefore, the ink does not flow from the surface of the insulating layer 95 to the downstream side, and the ink is not discharged from the discharge port 85*a*. Consequently, the ink I is discharged through the discharge port 85*a* in the two individual channels 85 of the ink channel 82 on the right end where both the common electrode 87 and the individual electrode 92 are at the ground electric potential. Thus, even in the third embodiment, the matrix drive is available.

Moreover, in this third embodiment, the ink existed on the surface of the insulating layer 95 flows to the discharge port 85*a* to be discharged through the discharge port 85*a*, when the electric potential difference between the ink and the individual electrode 92 is less than the critical electric potential difference Va and the wetting angle of the ink on the surface of the insulating layer 95 becomes bigger than the critical wetting angel θa. Therefore, a pressure applying mechanism which applies a discharge pressure to the ink inside the individual channel 85 is not required, and it is possible to make simple the formation of the printer.

Even in this third embodiment, the combinations of the four electric potentials $V_1$ to $V_4$ are not restricted to the combinations shown in FIG. 33, and can take various values provided the relations mentioned above ($|V_3-V_1|<Va$, $|V_4-V_1|\geqq Va$, $V_3-V_2|\geqq Va$, and $|V_4-V_2|\geqq Va$) are satisfied. Some preferable examples of the combinations of these four electric potentials $V_1$ to $V_4$ will be described below.

First Example

Figure 38:
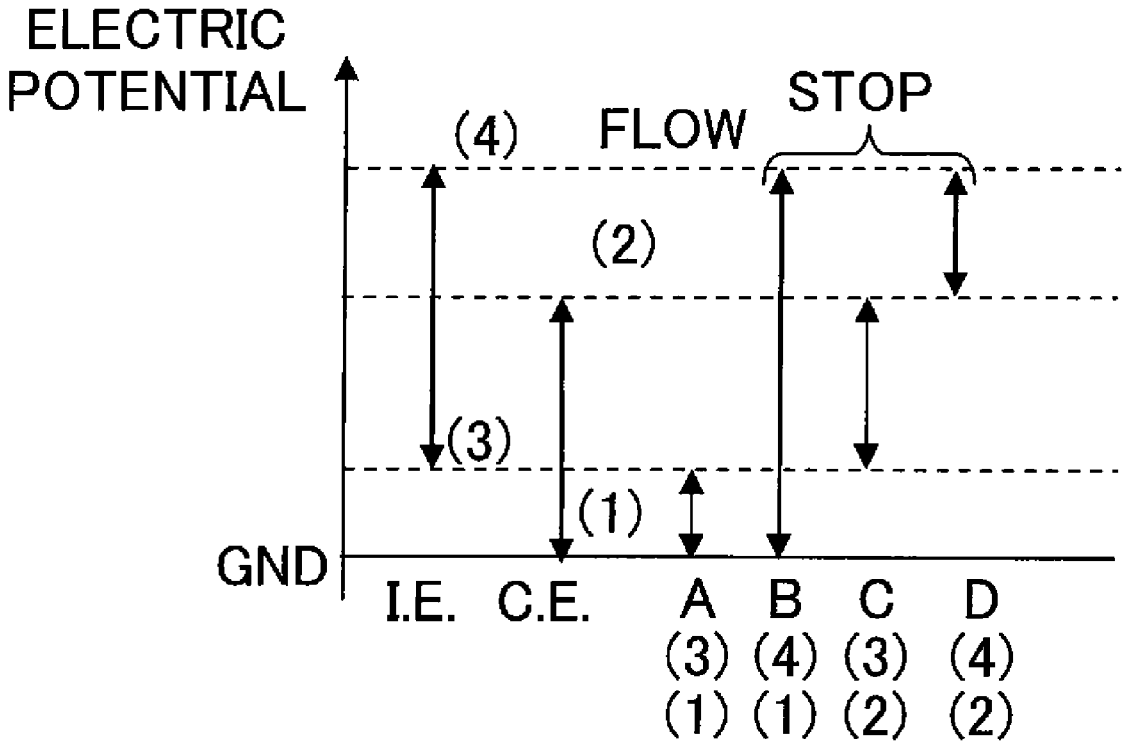
FIG. 38 is a diagram showing a relation of four electric potentials $V_1$ to $V_4$ in a first example of the third embodiment.

It is preferable that any one of the four electric potentials $V_1$ to $V_4$ is the ground electric potential. In FIG. 38, the first electric potential $V_1$ is the ground electric potential. In this case, it is possible to make simple the formation of the driver IC 91, and to reduce the cost, because the types of electric potentials applied to the common electrode 87 and the individual electrode 92 from the driver IC 91 are reduced to three types.

Second Example

Figure 39:
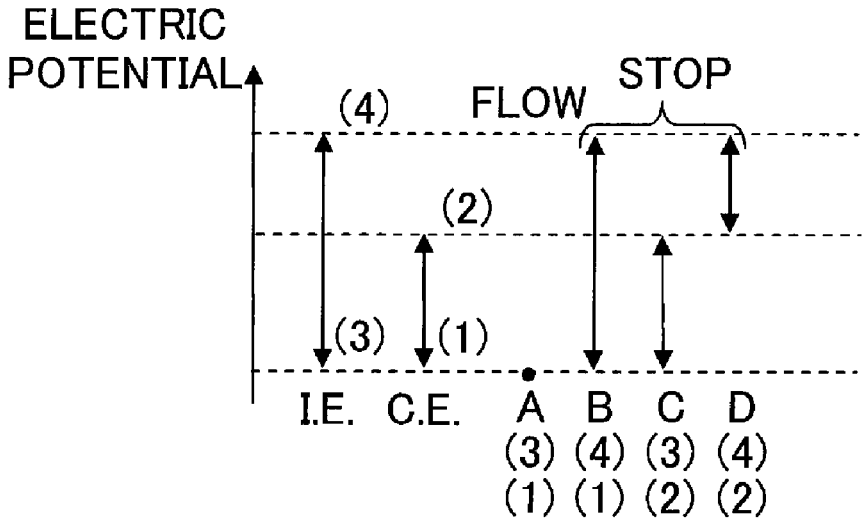
FIG. 39 is a diagram showing a relation of four electric potentials $V_1$ to $V_4$ in a second example of the third embodiment.

Moreover, as shown in FIG. 39, it is preferable that the first electric potential $V_1$ and the third electric potential $V_3$ are the same electric potential. Even in this case, since the types of electric potentials applied to the common electrode 87 and the individual electrode 92 from the driver IC 91 are reduced to three types, it is possible to make simple the formation of the driver IC 91, and to reduce the cost of the electrical system.

Third Example

Figure 40:
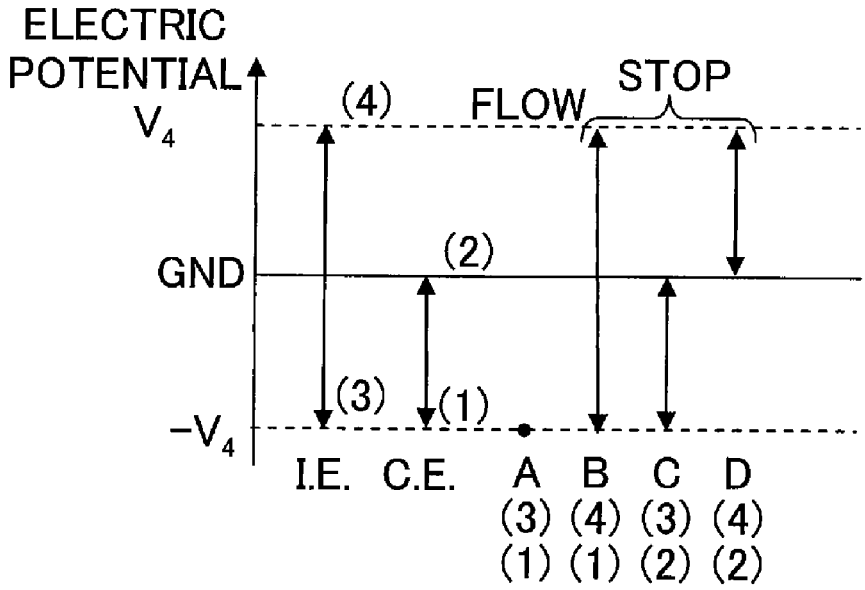
FIG. 40 is a diagram showing a relation of four electric potentials $V_1$ to $V_4$ in a third example of the third embodiment.

Moreover, in the third embodiment described above, the first electric potential $V_1$ and the third electric potential $V_3$ were the same electric potential, and further, the second electric potential $V_2$ was the intermediate electric potential between the second electric potential $V_1$, and the fourth electric potential $V_4$, and $V_2=(V_3+V_1)/2$ (refer to FIG. 33). However, it is possible to satisfy this condition even in a combination other than the combination mentioned above, For example, as shown in FIG. 40, both the first electric potential $V_1$ and the third electric potential $V_3$ may be the same electric potential ($=-V_4$), and the second electric potential $V_2$ may be the ground electric potential which is an intermediate electric potential between the first electric potential $V_1$ and the fourth electric potential $V_4$. Even in a third example, since a difference between the electric potential difference A and the electric potential difference B, C or D can be let to be greater than or equal to $|V_4-V_1/2$ ($=V_4$) all the time, it is possible to perform stably the ink transporting operation and the (ink transporting) stopping operation, where the potential difference A is a potential difference between the common electrode 87 and the individual electrode 92 in the individual channel 85 which transports makes flow the ink to the discharge port 85*a*, and the electric potential difference B, C and D are potential differences between the common electrode 87 and the individual electrode 92 in the individual channel 85 which does not transport the ink. Furthermore, since the second electric potential $V_2$ is the ground electric potential, the types of the electric potentials applied to the common electrode 87 and the individual electrode 92 by the driver IC 91 are reduced to two types namely the first electric potential $V_1$ (=third electric potential $V_3$) and the fourth electric potential $V_4$. Therefore, it is possible to make simple the formation of the driver IC 91, and the effect of the cost reduction is improved.

The embodiments mentioned above are examples in which the present invention is applied to a printer recording (an image) by transporting ink to a recording paper. However, the present invention is also applicable to other liquid transporting apparatuses which transport liquids other than ink. The present invention is also applicable to apparatuses such as an apparatus which forms a wiring pattern by transferring to a substrate an electroconductive liquid in which metallic nano particles are dispersed, an apparatus which manufactures DNA chips by a solution in which DNA is dispersed, an apparatus which manufactures display panels by a solution in which an organic compound such as an EL (electroluminescent) light emitting material is dispersed, and an apparatus which manufactures color filters for liquid crystal display by using a solution in which pigments for color filter are dispersed. Moreover, liquids which are used in these liquid transporting apparatuses are not restricted to electroconductive liquids, and may be a liquid which is let to have an electroconductivity similarly as the electroconductive liquid, by dispersing an electroconductive additive in a nonconductive liquid.

What is claimed is:

1. A liquid transporting apparatus which transports a liquid having an electroconductivity, comprising:

a liquid transporting head which includes:

a plurality of common channels, a plurality of individual channel groups each of which corresponds to the common channels, each of which has a plurality of individual channels branched from one of the common channels, a plurality of common electrodes each of which is arranged on a channel forming surface of one of the common channels, and is in direct contact with the liquid in one of the common channels, a plurality of individual electrodes each of which is arranged on a channel forming surface of one of the individual channels, and an insulating layer which is arranged to cover each of the individual electrodes, and in which a wetting angle of the liquid on a surface of the insulating layer is decreased to be not more than a critical wetting angle at which the liquid is remainable on the surface thereof, when an electric potential difference between the liquid in the individual channel and the individual electrode is not less than a predetermined critical electric potential difference; and a control mechanism which controls a liquid transporting operation of the liquid transporting head, wherein an individual electrode among the individual electrodes provided to one of the individual channels of an individual channel group among the individual channel groups corresponds to another individual electrode provided to one of the individual channels of another individual channel group, and the corresponding individual electrodes are mutually conducted.

2. The liquid transporting apparatus according to claim 1, further comprising:

an electric potential applying unit which applies an electric potential to the common electrodes and the individual electrodes, wherein;

each of the individual channels has a discharge port through which a liquid is discharged, and the control mechanism sets the electric potential difference between the liquid and the individual electrode by applying a predetermined electric potential selectively to the common electrodes and the individual electrodes with the electric potential applying unit.

3. The liquid transporting apparatus according to claim 2, further comprising:

a pressure applying mechanism which applies a pressure which generates a flow of the liquid toward the discharge port to the liquid in the individual channels, wherein a magnitude of the pressure applied to the liquid by the pressure applying mechanism is such that the liquid is discharged from the discharge port when the electric potential difference between the liquid and the individual electrodes is set to be not less than the predetermined critical electric potential difference by the control mechanism.

4. The liquid transporting apparatus according to claim 1, wherein:

the electric potential applying unit applies selectively two types of predetermined electric potentials, which are a first electric potential and a second electric potential, to the common electrodes, and applies selectively another two types of predetermined electric potentials, which are a third electric potential and a fourth electric potential, to the individual electrodes which are mutually conducted, and only when the first electric potential is applied to a certain common electrode among the common electrodes and the third electric potential is applied to an individual electrode among the individual electrodes formed on the individual channels of the individual channel groups corresponding to a common channel on which the certain common electrode is formed, a potential difference between the liquid in the individual channel, to which the individual electrode is provided, and the individual electrode becomes not less than the critical electric potential difference.

5. The liquid transporting apparatus according to claim 4, wherein among the first to fourth electric potentials, the third electric potential is maximum and the first electric potential is minimum, or the first electric potential is maximum and the third electric potential is minimum.

6. The liquid transporting apparatus according to claim 4, wherein one of the first to fourth electric potentials is ground electric potential.

7. The liquid transporting apparatus according to claim 4, wherein electric potentials are same between one of pairs of the first electric potential and the fourth electric potential, the second electric potential and the third electric potential, and the second electric potential and the fourth electric potential.

8. The liquid transporting apparatus according to claim 4, wherein the fourth electric potential is equal to the first electric potential $V_1$, and $V_2=(V_1+V_3)/2$ is satisfied when the second electric potential is $V_2$ and the third electric potential is $V_3$.

9. The liquid transporting apparatus according to claim 8, wherein the first electric potential and the fourth electric potential are ground electric potential.

10. The liquid transporting apparatus according to claim 8, wherein the second electric potential is ground electric potential.

11. The liquid transporting apparatus according to claim 4, wherein $V_2=(2V_3+V_1)/3$ and $V_4=(V_3+2V_1)/3$ are established when the first to forth electric potentials are $V_1$, $V_2$, $V_3$ and $V_4$ respectively.

12. The liquid transporting apparatus according to claim 2, wherein:

when the electric potential difference between the liquid and an individual electrode among the individual electrodes is not less than the critical electric potential difference, the liquid exists on the surface of the insulating layer and a meniscus of the liquid is formed near the discharge port, and the liquid in the individual channels is not discharged from the discharge port; and when the electric potential difference between the liquid and an individual electrode among the individual electrodes is set to be less than the predetermined critical electric potential difference, the liquid which existed on the surface of the insulating layer moves to the discharge port to be discharged from the discharge port.

13. The liquid transporting apparatus according to claim 12, wherein:

the electric potential applying unit applies selectively two types of predetermined electric potentials, which are a first electric potential and a second electric potential, to the common electrodes, and applies selectively two types of predetermined electric potential, which are a third electric potential and a fourth electric potential, to the individual electrodes which are mutually conducted; and only when the electric potential applying unit applies the first electric potential to a certain common electrode among the common electrodes, and applies the third electric potential to an individual electrode corresponding to the certain common electrode, a potential difference between the liquid in an individual channel, to which the individual electrode is provided, and the individual electrode becomes less than the critical electric potential difference.

14. The liquid transporting apparatus according to claim 13, wherein one of the first to forth electric potentials is ground electric potential.

15. The liquid transporting apparatus according to claim 13, wherein the first electric potential and the third electric potential are same.

16. The liquid transporting apparatus according to claim 15, wherein $V_2=(V_1+V_4)/2$ is satisfied when the first electric potential is $V_1$, the second electric potential is $V_2$, and the fourth electric potential is $V_4$.

17. The liquid transporting apparatus according to claim 16, wherein the first electric potential and the third electric potential are ground electric potential.

18. The liquid transporting apparatus according to claim 16, wherein the second electric potential is ground electric potential.

19. The liquid transporting apparatus according to claim 1, further comprising:

a common liquid-inflow section which is provided on an upstream of the common channels, and which communicates with the common channels; and partition walls each of which defines one of the common channels and each of which is extended up to a position between the common electrodes provided to the common channels.

20. The liquid transporting apparatus according to claim 19, wherein a throttle having a channel area narrower than a channel area of each of the common channels is provided to a communicating portion between the each of the common channels and the common liquid-inflow section.

21. The liquid transporting apparatus according to claim 1, wherein through holes are formed in the liquid transporting head at positions each overlapping with one of the individual electrodes of the individual channels; a wiring connected to the control mechanism is formed on a surface of the liquid transporting head opposite to the individual channels, and the individual electrodes and the wiring are connected by an electroconductive member filled in the through holes.

22. The liquid transporting apparatus according to claim 1, wherein:

through holes are formed in the liquid transporting head at positions each overlapping with one of the common electrodes of the common channels; a wiring connected to the control mechanism is formed on a surface of the liquid transporting head on a side opposite to the common liquid channels; the common electrodes and the wiring are connected by an electroconductive member filled in the through holes.

23. The liquid transporting apparatus according to claim 1, wherein the liquid transporting apparatus is a printer.

24. A liquid transporting head which transports a liquid having an electroconductivity, comprising:

a plurality of common channels;

a plurality of individual channel groups which correspond to the common channels respectively, and each of which has a plurality of individual channels branched from one of the common channels;

a plurality of common electrodes each of which is arranged on a channel forming surface of one of the common channels, and is in direct contact with the liquid in one of the common channels;

a plurality of individual electrodes each of which is arranged on a channel forming surface of one of the individual channels; and an insulating layer which is arranged to cover each of the individual electrodes, and in which a wetting angle of the liquid on a surface of the insulating layer is decreased to be not more than a critical wetting angle at which the liquid is remainable on the surface thereof, when an electric potential difference between the liquid in the individual channels and the individual electrodes is not less than a predetermined critical electric potential difference, wherein an individual electrode among the individual electrodes provided to an individual channel among the individual channels of one of the individual channel groups corresponds to another individual electrode provided to another individual channel of another individual channel group, and the corresponding individual electrodes are mutually conducted.

* * * * *